US005499004A

United States Patent [19]

Noguchi et al.

[11] Patent Number: 5,499,004

[45] Date of Patent: Mar. 12, 1996

[54] DIELECTRIC FILTER HAVING INTERSTAGE COUPLING USING ADJACENT ELECTRODES

[75] Inventors: Toshiharu Noguchi; Kazuhiro Eguchi; Hiroshi Ohno, all of Miyazaki, Japan

[73] Assignee: Matsushita Electric Industrial Co., Ltd., Japan

[21] Appl. No.: 202,073

[22] Filed: Feb. 25, 1994

[30] Foreign Application Priority Data

Mar. 12, 1993 [JP] Japan ..... 5-051945
Dec. 1, 1993 [JP] Japan ..... 5-301565

[51] Int. Cl.[6] ..... H01P 1/205

[52] U.S. Cl. ..... 333/202; 333/206; 333/222

[58] Field of Search ..... 333/202, 206, 333/207, 222, 223

[56] References Cited

U.S. PATENT DOCUMENTS

| | | | |
|---|---|---|---|
| 4,673,902 | 6/1987 | Takeda et al. | 333/202 |
| 4,733,208 | 3/1988 | Ishikawa et al. | 333/206 X |
| 5,130,683 | 7/1992 | Agahi-Kesheh et al. | 333/203 |
| 5,146,193 | 9/1992 | Sokola | 333/206 |

FOREIGN PATENT DOCUMENTS

| | | | |
|---|---|---|---|
| 0444948 | 9/1991 | European Pat. Off. . | |
| 0483820 | 5/1992 | European Pat. Off. . | |
| 0576273 | 12/1993 | European Pat. Off. . | |
| 62-43904 | 2/1987 | Japan . | |
| 0037101 | 2/1989 | Japan | 333/202 |
| 0053601 | 3/1989 | Japan | 333/202 |
| 2-46085 | 12/1990 | Japan . | |
| 0006103 | 1/1991 | Japan | 333/206 |
| 4-103202 | 4/1992 | Japan . | |
| 0150101 | 5/1992 | Japan | 333/222 |
| 4167701 | 6/1992 | Japan | 333/206 |
| 5175704 | 7/1993 | Japan | 333/206 |

OTHER PUBLICATIONS

Hano et al., "A Bandpass Filter Using Direct—Coupled . . . Resonators", Microwave Journal, Nov. 1987, pp. 141–143, 145, 147, 148, 150, 152, 154, 156, 158, 160.

*Primary Examiner*—Benny Lee

[57] ABSTRACT

A dielectric filter comprises a pair of dielectric resonators 11 and 12, which have outer conductors 11*c* and 12*c* formed with cutouts 11*k* and 12*k*, respectively. Interstage coupling electrodes 11*f* and 12*f* are provided within the region of these cutouts 11*k* and 12*k*, so that the electrodes 11*f* and 12*f* do not contact with the conductors, such as outer conductors 11*c*, 12*c* and the inner conductors 11*d*, 12*d*. The dielectric resonators are connected in such a manner that these electrodes 11*f* and 12*f* are brought into contact with each other. Furthermore, input/output coupling electrodes 11*g* and 12*g* are provided within the region of the cutouts 11*k* and 12*k*. Then, by connecting the electrodes 11*f* and 12*f*, it becomes possible to provide a dielectric filter which is compact in size and capable of reducing the number of parts and, therefore, cheap in cost.

5 Claims, 21 Drawing Sheets

DIELECTRIC FILTER HAVING INTERSTAGE COUPLING USING ADJACENT ELECTRODES

BACKGROUND OF THE INVENTION

1. Field of the Invention

The present invention relates to a dielectric filter installed on a communication apparatus, such as a portable telephone and a wireless telephone.

2. Description of the Prior Art

A conventional dielectric filter will be explained hereinafter.

FIG. 27 is a perspective view showing a conventional dielectric filter. Reference numerals 1 and 2 represent dielectric resonators comprising: dielectric base bodies 1*a*, 2*a* made of dielectric material, with centrally axially extending through holes 1*b*, 2*b*; outer conductors 1*c*, 2*c* surrounding outer surfaces of the dielectric base bodies 1*a*, 2*a*; inner conductors 1*d*, 2*d* provided along inner surfaces of the through holes 1*b*, 2*b*; and connecting conductors 1*e* and 2*e* connecting the outer conductors 1*c*, 2*c* and the inner conductors 1*d*, 2*d*. A reference numeral 5 represents a coupling substrate 5 comprising conductors 5*a*, 5*b*, 5*c* and 5*d* formed on a dielectric substrate (aluminum substrate or the like). This connecting substrate 5 realizes input/output coupling capacitances (one is between conductors 5*a* and 5*c*, the other between conductors 5*b* and 5*d*) and an interstage coupling capacitance (between 5*a* and 5*b*). FIG. 28(A) is a detailed front view showing the coupling substrate 5 of the conventional dielectric filter, and FIG. 28(B) is a detailed rear view showing the coupling substrate 5 of the conventional dielectric filter. Reference numerals 6 and 7 represent central conductors connecting the inner conductors 1*d*, 2*d* and the coupling substrate 5 electrically and mechanically. Reference numerals 8 and 9 represent input and output terminals which are connected to the conductors 5*c*, 5*d* of the coupling substrate 5 electrically and mechanically by means of solder or the like.

However, this kind of conventional dielectric filter inherently requires numerous components, such as the coupling substrate 5, central conductors 6, 7, and input/output terminals 8, 9. This encounters with the difficulty in reducing the size of a dielectric filter. Furthermore, mass-productivity is not good due to a large number of parts and time-consuming production process.

SUMMARY OF THE INVENTION

Accordingly, in view of above-described problems encountered in the prior art, an object of the present invention is to provide a dielectric filter capable of reducing the size and the number of parts and having excellent mass productivity.

In order to accomplish above purpose, a first aspect of the present invention provides a dielectric filter comprising a plurality of dielectric resonators, each of said dielectric resonators comprising: a dielectric base body of a cylindrical shape, with an outer side surface defining an outer configuration of said dielectric body and an inner side surface defining a through hole formed in said dielectric base body; an outer conductor provided along said outer side surface of said dielectric base body; an inner conductor provided along said inner side surface of said dielectric base body; a connecting conductor provided at an end surface of said dielectric base body to connect said outer and inner conductors; a plurality of electrodes provided on said outer side surface so as not to be electrically connected with said conductors, each of said electrodes being spaced one another; said plurality of dielectric resonators being connected with each other, in such a manner that at least one of electrodes of one dielectric resonator is electrically connected with at least one of electrodes of another dielectric resonator.

A second aspect of the present invention provides a dielectric filter comprising a plurality of dielectric resonators, each of said dielectric resonators comprising: a dielectric base body of a cylindrical shape, with an outer side surface defining an outer configuration of said dielectric base body and an inner side surface defining a through hole formed in said dielectric base body; an outer conductor provided along said outer side surface of said dielectric base body; an inner conductor provided along said inner side surface of said dielectric base body; a connecting conductor provided at an end surface of said dielectric base body to connect said outer and inner conductors; an interstage coupling electrode provided on said outer side surface so as not to be electrically connected with said conductors; said plurality of dielectric resonators being connected with each other, in such a manner that the interstage coupling electrode of one dielectric resonator is electrically connected with the interstage coupling electrode of another dielectric resonator.

A third aspect of the present invention provides a dielectric filter comprising a pair of dielectric resonators, each of said dielectric resonators comprising: a dielectric base body of a cylindrical shape, with an outer side surface defining an outer configuration of said dielectric base body and an inner side surface defining a through hole formed in said dielectric base body; an outer conductor provided along said outer side surface of said dielectric base body; an inner conductor provided along said inner side surface of said dielectric base body; a connecting conductor provided at one end surface of said dielectric base body to connect said outer and inner conductors; and said plurality of dielectric resonators being connected with each other, in such a manner that the outer conductors of said dielectric resonators are connected with each other at confronting outer side surfaces thereof; wherein interstage coupling electrodes to be connected with each other are provided on said confronting outer side surfaces so as not to be brought into contact with the outer conductor, and input/output coupling electrodes are provided on both of said dielectric resonators.

A fourth aspect of the present invention provides a dielectric filter comprising a pair of dielectric resonators, each of said dielectric resonators comprising: a dielectric base body of a cylindrical shape, with an outer side surface defining an outer configuration of said dielectric base body and an inner side surface defining a through hole formed in said dielectric base body; an outer conductor provided along said outer side surface of said dielectric base body; an inner conductor provided along said inner side surface of said dielectric base body; a connecting conductor provided at one end surface of said dielectric base body to connect said outer and inner conductors; and said plurality of dielectric resonators being connected with each other, in such a manner that the outer conductors of said dielectric resonators are connected with each other at confronting outer side surfaces thereof; wherein cutouts of said outer conductors are provided so as to bare the outer side surfaces of said dielectric base body other than said confronting outer side surfaces, and interstage coupling electrodes and input/output coupling electrodes are provided within the area of said cutouts so that said interstage coupling electrodes are connected with each other through a terminal.

A fifth aspect of the present invention provides a dielectric filter comprising a pair of dielectric resonators, each of said dielectric resonators comprising: a dielectric base body of a cylindrical shape, with an outer side surface defining an outer configuration of said dielectric base body and an inner side surface defining a through hole formed in said dielectric base body; an outer conductor provided along said outer side surface of said dielectric base body; an inner conductor provided along said inner side surface of said dielectric base body; a connecting conductor provided at one end surface of said dielectric base body to connect said outer and inner conductors; and said plurality of dielectric resonators being connected with each other in such a manner that the outer conductors of said dielectric resonators are connected with each other at confronting outer side surfaces thereof, and further said dielectric resonators being placed in opposed relationship so that respective open ends thereof face opposite directions; wherein interstage coupling electrodes to be connected with each other are provided on said confronting outer side surfaces so as not to be brought into contact with the outer conductor, and input/output coupling electrodes are provided on both of said dielectric resonators.

A sixth aspect of the present invention provides a dielectric filter comprising a plurality of dielectric resonators, each of said dielectric resonators comprising: a dielectric base body of a cylindrical shape, with an outer side surface defining an outer configuration of said dielectric base body and an inner side surface defining a through hole formed in said dielectric base body; an outer conductor provided along said outer side surface of said dielectric base body; an inner conductor provided along said inner side surface of said dielectric base body; a connecting conductor provided at an end surface of said dielectric base body to connect said outer and inner conductors; an interstage coupling electrode provided on said outer side surface so as not to be electrically connected with said conductors; a cutout of said outer conductor partly baring said outer side surface of said dielectric base body, said cutout being provided near an open end of said dielectric base body so as to extend to said open end; said plurality of dielectric resonators being connected with each other, in such a manner that the interstage coupling electrode of one dielectric resonator is electrically connected with the interstage coupling electrode of another dielectric resonator.

A seventh aspect of the present invention provides a dielectric filter comprising a pair of dielectric resonators, each of said dielectric resonators comprising: a dielectric base body of a cylindrical shape, with an outer side surface defining an outer configuration of said dielectric base body and an inner side surface defining a through hole formed in said dielectric base body; an outer conductor provided along said outer side surface of said dielectric base body; an inner conductor provided along said inner side surface of said dielectric base body; a connecting conductor provided at an end surface of said dielectric base body to connect said outer and inner conductors; a first cutout of said outer conductor partly baring said outer side surface of said dielectric base body; an interstage coupling electrode provided within said first cutout so as not to be electrically connected with said conductors; a second cutout of said outer conductor partly baring said outer side surface of said dielectric base body, said second cutout being separated from said first cutout; wherein a third cutout of said outer conductor is provided on at least either of said dielectric resonators so that said third cutout reaches an open end of said dielectric base body, and the interstage coupling electrodes of said dielectric resonators are connected with each other.

And, an eighth aspect of the present invention provides a dielectric filter comprising a pair of dielectric resonators, each of said dielectric resonators comprising: a dielectric base body of a cylindrical shape, with an outer side surface defining an outer configuration of said dielectric base body and an inner side surface defining a through hole formed in said dielectric base body; an outer conductor provided along said outer side surface of said dielectric base body; an inner conductor provided along said inner side surface of said dielectric base body; a connecting conductor provided at an end surface of said dielectric base body to connect said outer and inner conductors; a first cutout of said outer conductor partly baring said outer side surface of said dielectric base body; an interstage coupling electrode provided within said first cutout so as not to be electrically connected with said conductors; wherein a second cutout of said outer conductor is provided on both of said dielectric resonators so that said second cutout reaches an open end of said dielectric base body, and the interstage coupling electrodes of said dielectric resonators are connected with each other.

The above and other objects, features and advantages of the present invention will become more apparent from the following detailed description which is to be read in conjunction with the accompanying drawings.

DETAILED DESCRIPTION OF THE PREFERRED EMBODIMENTS

Hereinafter, preferred embodiments of the present invention will be explained in detail with reference to accompanying drawings.

FIRST EMBODIMENT

Figure 1:
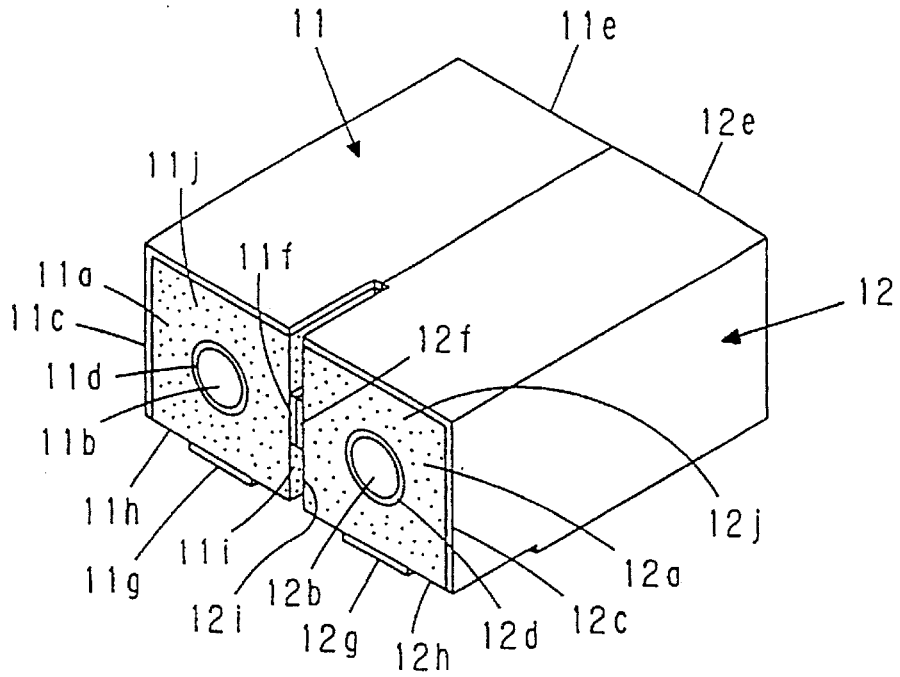
FIG. 1 is a perspective view showing a dielectric filter in accordance with a first embodiment of the present invention.
Figure 2:
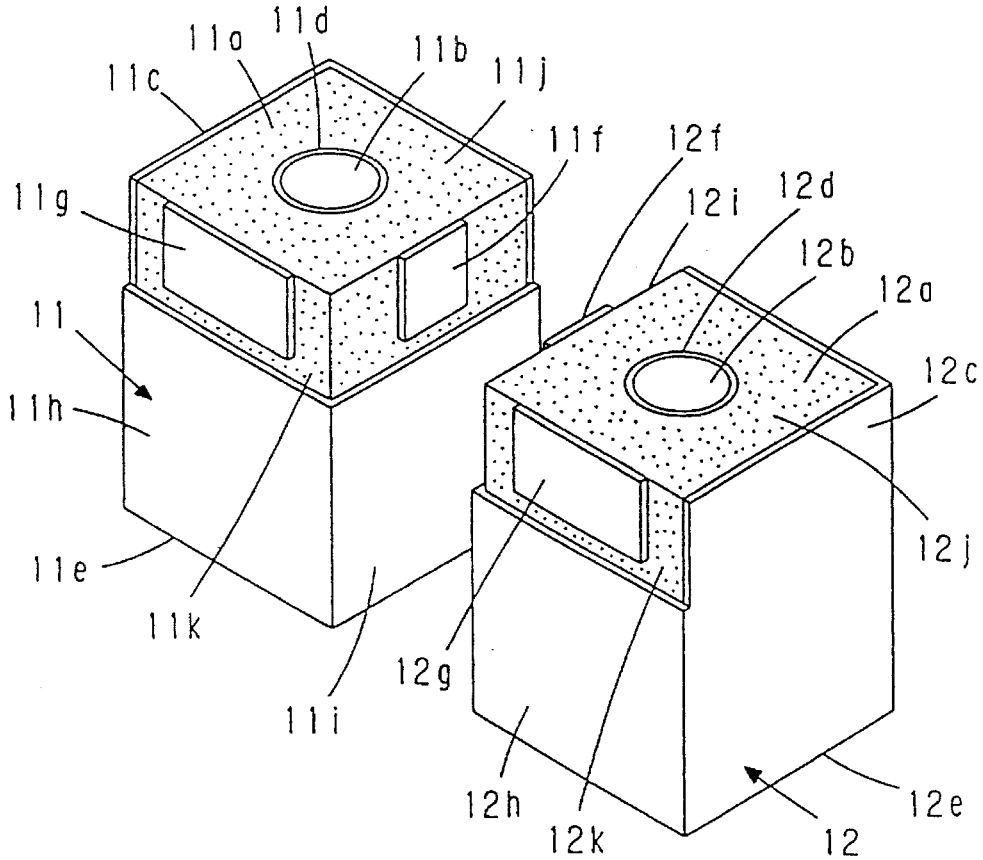
FIG. 2 is an exploded perspective view showing the dielectric filter in accordance with the first embodiment of the present invention.

FIGS. 1 and 2 are perspective and exploded views showing a dielectric filter of the first embodiment of the present invention. In FIGS. 1 and 2, reference numerals 11 and 12 represent dielectric resonators. Hereinafter, taking the dielectric resonator 11 of these two dielectric resonators, a construction of the dielectric resonator will be explained. A dielectric base body 11*a* made of dielectric material, such as $BaO\text{-}TiO_2\text{-}Nd_2O_3$, $BaO\text{-}TiO_2$, $ZrO_2\text{-}SnO_2\text{-}TiO_2$, $BaO\text{-}Sm_2O_3\text{-}TiO_2$, is formed with a centrally axially extending through hole 11*b*. The dielectric base body 11*a* has an outer configuration of rectangular parallelopiped having a square cross section, while the through hole 11*b* has a circular cross section.

Figure 35:
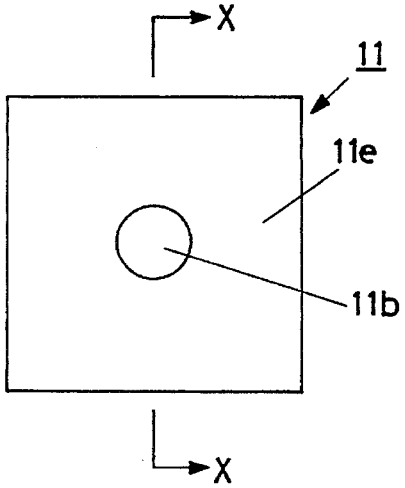
FIG. 35 is a rear view showing one dielectric resonator 11 of the dielectric filter in accordance with the first embodiment of the present invention.
Figure 36:
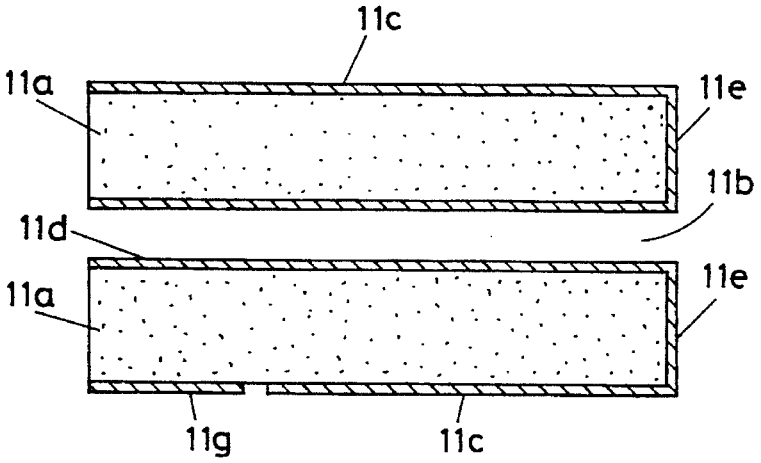
FIG. 36 is a cross-sectional view showing the dielectric resonator 11, taken along a line X—X of FIG. 35.

An outer conductors 11*c* is provided on the outer side surface of the dielectric base body 11*a* so as to surround it. An inner conductor 11*d* is provided along the inner side surface of the through hole 11*b*. The outer conductor 11*c* and the inner conductor 11*d* are connected with each other via a connecting conductor 11*e*. This connecting conductor 11*e* is provided on a closed end surface, i.e. a base of the rectangular parallelopiped, of the dielectric base body 11*a* as shown in FIGS. 35 and 36. Of four outer side surfaces of the dielectric base body 11*a*, two side surfaces 11*i* and 11*h* are partly cut off so that the dielectric base body 11*a* is bared near the open end 11*j*. Namely, a cutout 11*k* of the outer conductor 11*c* bridging both the two side surfaces 11*i* and 11*h* is formed near the open end of the dielectric base body 11*a*.

Furthermore, an interstage coupling electrode 11*f* is provided within the region of the cutout 11*k* on the outer side surface 11*i*, so that this interstage coupling electrode 11*f* does not contact with other conductors. In the same manner, an input/output coupling electrode 11*g* is provided within the region of the cutout 11*k* on the outer side surface 11*h*, so that this input/output coupling electrode 11*g* does not contact with other conductors.

Likewise, the other dielectric resonator 12 comprises: a dielectric base body 12*a*, a through hole 12*b*, an outer conductor 12*c*, an inner conductor 12*d*, a connecting conductor 12*e*, an interstage coupling electrode 12*f*, an input/output coupling electrode 12*g*, outer side surfaces 12*h* and 12*i*, an open end 12*j*, and a cutout 12*k*.

The like parts between the dielectric resonators 11 and 12 are denoted by the same reference alphabet throughout views. (For example, the dielectric base body 11*a* is substantially identical with the dielectric base body 12*a*). However, as apparent from FIG. 2, the relationship between the dielectric resonator 11 and the dielectric resonator 12 are mirror symmetry. Therefore, in production of each dielectric resonator, it is necessary to pay attention to the positional relationship between the electrodes 11*f*, 11*g* and 12*f*, 12*g*.

More specifically, the dielectric resonator 11 and the dielectric resonator 12 are connected by means of, for example, cream solder in such a manner that the electrodes 11*f* and 12*f* confront and contact with each other and the electrodes 11*g* and 12*g* are placed on the same plane.

Furthermore, the outer conductors 11*c*, 12*c*, inner conductors 11*d*, 12*d*, connecting conductors 11*e*, 12*e*, electrodes 11*f*, 12*f*, and electrodes 11*g*, 12*g* (hereinafter, these components are referred to as conductor film) are basically thin film made of conductive material such as copper and silver. The thickness of the film is approximately 5 μm. Although the conductor film is a single layer in this embodiment, it is needless to say that two or more layer structure can be allowed. Regarding the film thickness of approximately 5 μm, this value should be adequately changed depending on the condition of the dielectric filter in service.

Although the electrodes 11*g*, 12*g* and 11*f*, 12*f* are rectangular in this first embodiment, the configuration of these electrodes 11*g*, 12*g* and 11*f*, 12*f* can be any other shape, such as circle, ellipse, and polygon.

Figure 3:
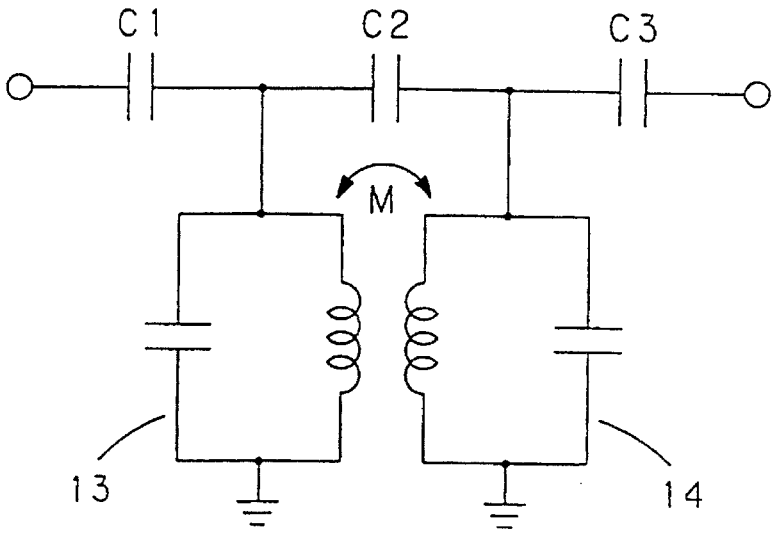
FIG. 3 is a circuit diagram showing an equivalent circuit of the dielectric filter in accordance with the first embodiment of the present invention.

FIG. 3 is a circuit diagram showing an equivalent circuit of the dielectric filter in accordance with the first embodiment of the present invention. In FIG. 3, a reference numeral 13 represents an equivalent circuit of the dielectric resonator 11 and a reference numeral 14 represents an equivalent circuit of the other dielectric resonator 12. C1 represents a capacitance between the electrode 11*g* and the inner conductor 11*d*, and C3 represents a capacitance between the electrode 12*g* and the inner conductor 12*d*. C2 represents a composite capacitance of two capacitances—one is a capacitance between the electrodes 11*f* and 11*d*, and the other is a capacitance between the electrodes 12*f* and 12*d*. As understood from this equivalent circuit, the dielectric filter of the present embodiment has substantially the same circuit configuration as the conventional dielectric filter. Nevertheless, the structure of this embodiment is very simplified and compact when compared with that of the conventional one. In more detail, this embodiment no longer requires the central conductor and the dielectric substrate of the conventional dielectric filter. This results in 50% reduction of overall size.

Figure 4:
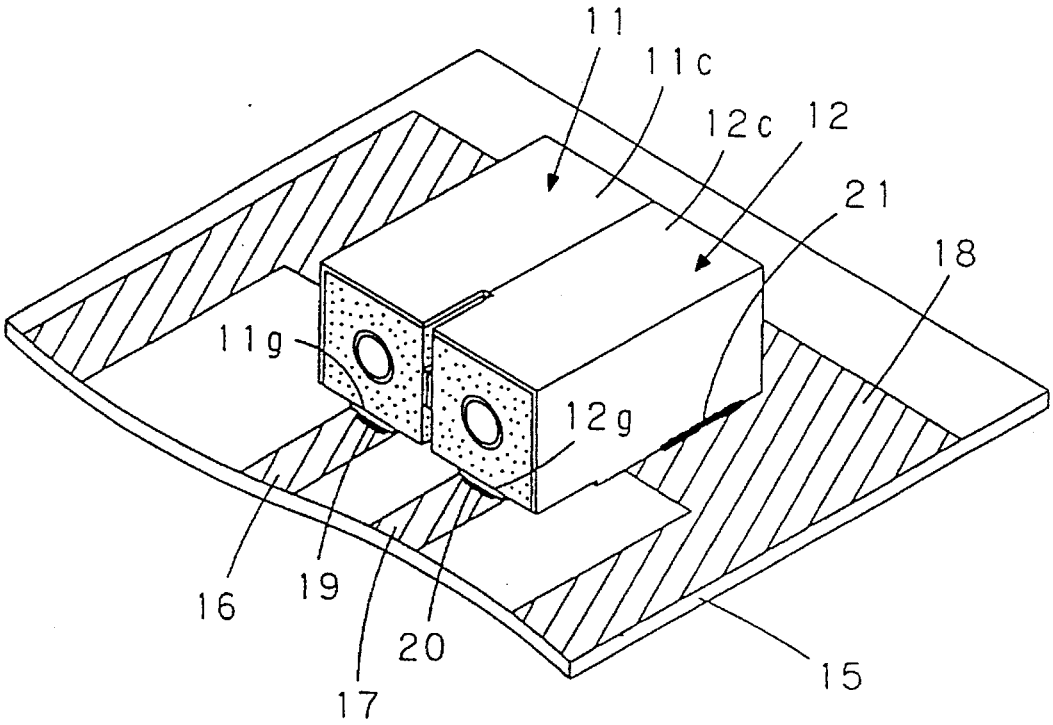
FIG. 4 is a perspective view showing the dielectric filter mounted on a substrate in accordance with the first embodiment of the present invention.

FIG. 4 is a perspective view showing the dielectric filter mounted on a substrate in accordance with the first embodiment of the present invention. In FIG. 4, a reference numeral 15 represents a printed circuit board constituted by insulating material, such as glass epoxy resin. Reference numerals 16 and 17 represent input/output pathways formed on the printed circuit board 15. Similarly, a reference numeral 18 represents a grounded pathway formed on the printed circuit board 15. The electrode 11*g* of the dielectric resonator 11 is connected onto the input/output pathway 16 by a solder 19, and the electrode 12*g* of the dielectric resonator 12 is connected onto the input/output pathway 17 by a solder 20. Furthermore, the outer conductors 11*c* and 12*c* of the dielectric resonators 11 and 12 are connected onto the grounded pathway 18 by solder 21. The input/output pathways 16, 17 and the grounded pathway 18 are formed by coating conductive paste, such as Ag paste, on the printed circuit board 15 in a predetermined pattern and then fixing it by printing.

Figure 5:
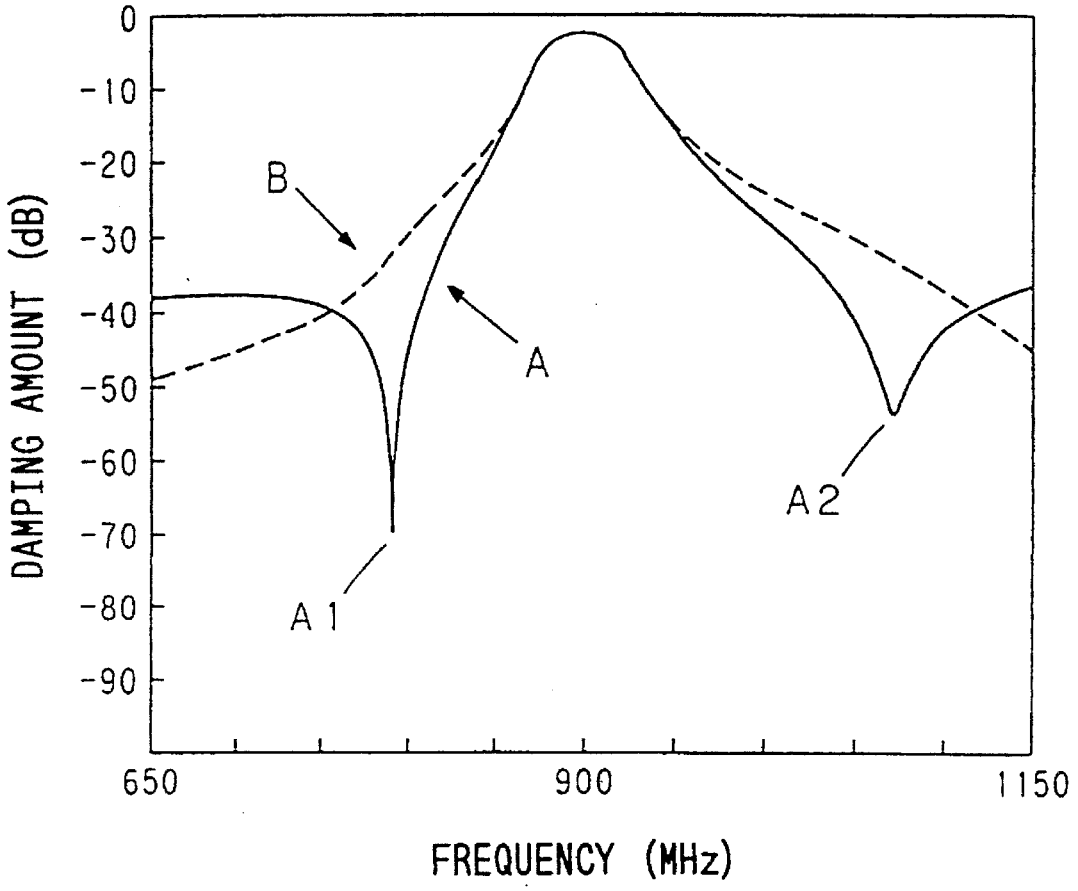
FIG. 5 is a graph showing comparison of damping characteristics between the first embodiment and a prior art.

FIG. 5 is a graph showing comparison of damping characteristics between the first embodiment and the prior art. In FIG. 5, a line A represents a characteristic curve of the first embodiment and B represents a characteristic curve of the prior art. As apparent from FIG. 5, the characteristic curve A of the first embodiment has two extremal values A1 and A2 at low and high frequencies. This is because, as shown in the equivalent circuit of FIG. 3, the interstage coupling causes a small amount of electromagnetic coupling M besides the coupling capacitance. On the contrary, the characteristic curve B of the prior art does not generate the similar extremal values.

A manufacturing method of the above-described dielectric filter will be explained hereinafter.

Figure 6:
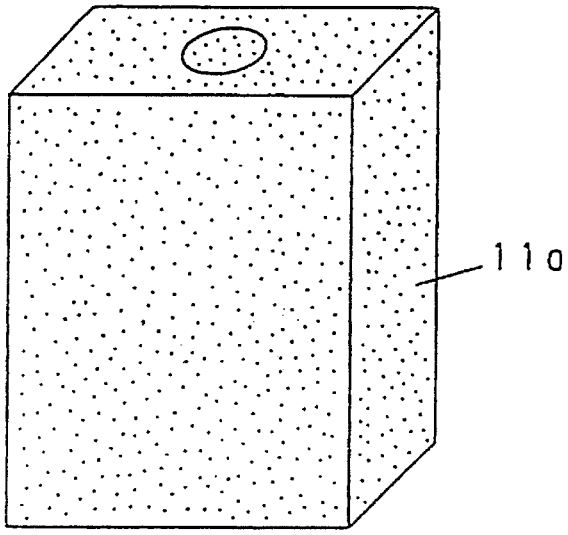
FIG. 6 is a perspective view showing a process of one manufacturing method of a dielectric resonator in accordance with the first embodiment of the present invention.

First of all, starting materials (for example, BaO, $TiO_2$, $Nd_2O_3$ or the like) are blended at a predetermined ratio. Then, the blended material is mixed by using a mill or else. Next, the mixed material is granulated by using a spray dryer or the like, so as to adjust the particle size and add binder. Subsequently, the granulated material is pelletized by a dry press so as to be formed into a predetermined shape. In turn, the pelletized material is sintered in a kiln at the temperature of 1300° C. to 1400° C. Thus, the dielectric base body 11*a* of cylindrical shape shown in FIG. 6 is obtained. Then, the conductor film is formed on the dielectric base body 11*a*. There are various method for forming the conductor film, several of which will be explained below.

Figure 7:
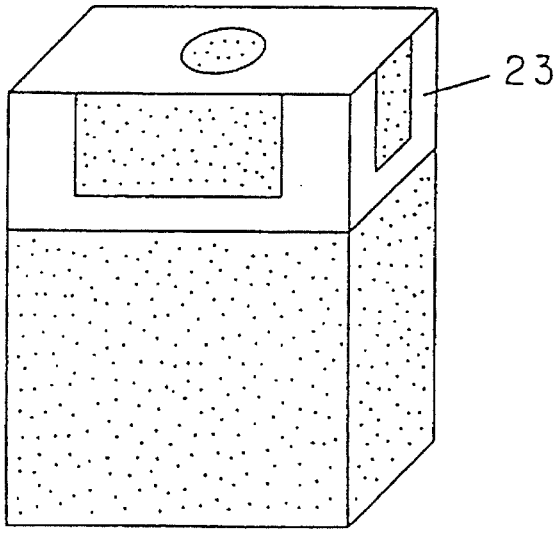
FIG. 7 is a perspective view showing another process of the one manufacturing method of the dielectric resonator in accordance with the first embodiment of the present invention.

A first method is applied in a case where copper is used as a material constituting the conductor film. The surface of the dielectric base body 11*a* is roughened by a barrelling machine or a blast device. Thereafter, the dielectric base body 11*a* is processed by etching until the roughness of the surface of the dielectric base body 11*a* becomes 5 μm to 9 μm. Etchant to be used in this etching will be, for example, HF-$HNO_2$ series. Subsequently, all the surface of the dielectric base body 11*a* is processed by stannous chloride or the like to give sensitivity. Then, palladium qualifying as catalytic metal is attached on all the surface of the dielectric base body 11*a*. Next, as shown in FIG. 7, a resist film 23 is formed partially on the dielectric base body 11*a*. Namely, this resist film 23 defines a region on which no conductor film of the dielectric base body 11*a* is provided—a region becoming the cutout 11*k* or the open end 11*j*. In the formation of this resist film 23, resist ink is coated on the dielectric base body 11*a* by the use of printing technology or else and then thus printed resist ink is dried until it hardens. Next, on thus manufactured dielectric base body 11*a*, there is formed a thin, first copper film by the electroless copper plating method. In this case, the first copper film is selectively formed only within a region where the resist film 23 is not provided. Subsequently, a second copper film is laminated on the first copper film by the electrolytic copper plating to form the conductor film whose thickness is approximately 5 μm. After the resist film 23 is removed by solvent or else, the dielectric resonator 11 (or 12) shown in FIGS. 1 and 2 is manufactured. Although the above manufacturing method coats the resist ink on the predetermined portion of the dielectric base body 11*a* using the printing technology and then dries and hardens the resist ink, another manufacturing method will allow the use of a photosensitive resist as a resist. That is, after the catalytic metal, such as palladium, is attached on the dielectric base body 11*a*, photosensitive resist is coated on all the surface of the dielectric base body 11*a*. Then, a predetermined portion of the photosensitive resist is exposed and hardened. Thereafter, the portion not being hardened by exposure is washed away by developing solution. Then, the resist film 23 shown in FIG. 7 will be obtained.

Figure 8:
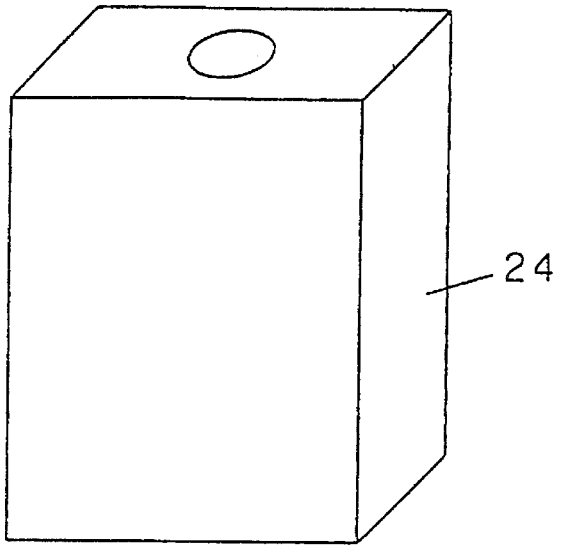
FIG. 8 is a perspective view showing still another process of the one manufacturing method of the dielectric resonator in accordance with the first embodiment of the present invention.
Figure 9:
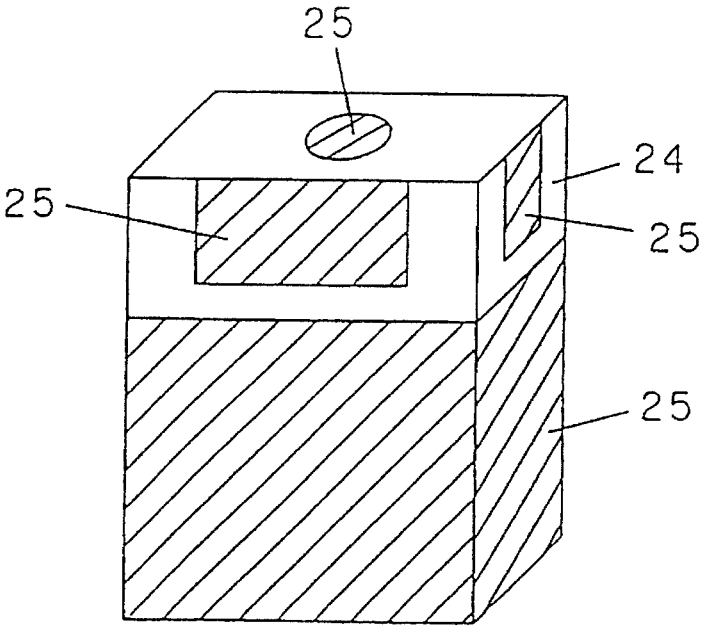
FIG. 9 is a perspective view showing still another process of the one manufacturing method of the dielectric resonator in accordance with the first embodiment of the present invention.

Next, still another manufacturing method of the conductor film will be explained. First of all, a conductor film 24 is formed on all the surface of the dielectric base body 11*a* as shown in FIG. 8. In this case, the conductor film 24 can be formed in the double-layer structure of copper as previously described. Furthermore, the conductor film 24 will be formed on the entire surface of the dielectric base body 11*a* by printing Ag paste on the entire surface of the dielectric base body 11*a*, drying this Ag paste, and applying a thermal treatment at the temperature of 800° C. to 900° C. In turn, a resist film 25 is formed on the conductor film 24 in a predetermined pattern as shown in FIG. 9. The method of forming this resist film 25 is the same as in the previous method. The resist film 25 is formed to define the region where the conductors and electrodes are formed. Thereafter, the unnecessary portion of the conductor film 24 is removed by using the etching technology, such as chemical etching or dry etching. Thus, the dielectric resonator 11 (or 12) shown in FIGS. 1 and 2 is manufactured.

Yet another manufacturing method of the conductor film will be explained. After forming the conductor film 24 on the entire surface of the dielectric base body 11*a* as shown in FIG. 8, cutting or laser machining is applied on the surface of the dielectric base body 11*a* to physically remove the predetermined portion of the surface. Thus, the dielectric resonator 11 (or 12) shown in FIGS. 1 and 2 is manufactured.

The dielectric resonators 11 and 12 thus constructed are disposed in such a manner that the electrodes 11*f* and 12*f* confront with each other. Then, the outer conductors 11*i* and 12*i* are connected by means of cream solder or the like. Similarly, the electrodes 11*f* and 12*f* are connected by means of cream solder or the like.

Next, a modified embodiment of the first embodiment will be explained.

Figure 10:
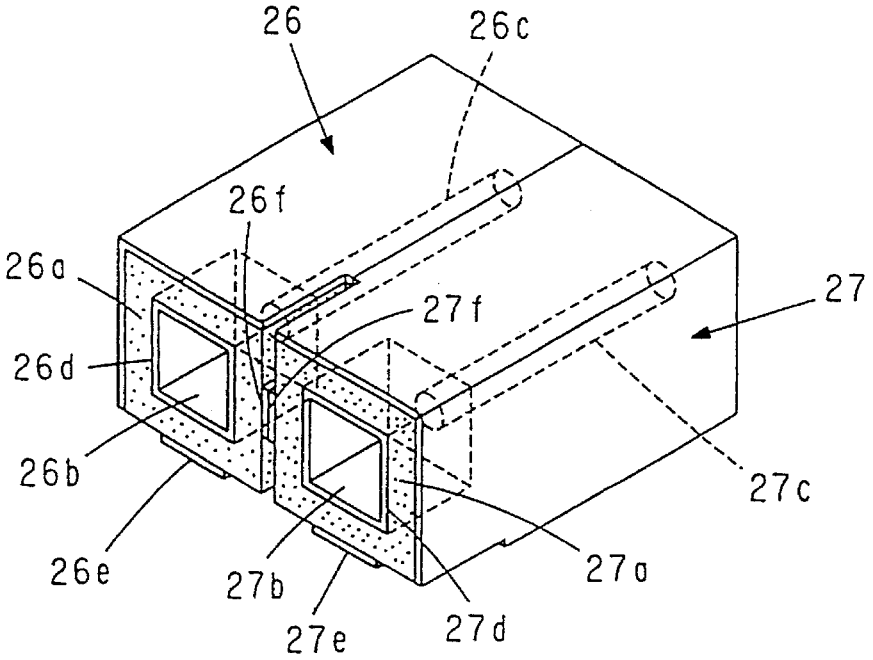
FIG. 10 is a perspective view showing a modified embodiment of the first embodiment of the present invention.
Figure 11:
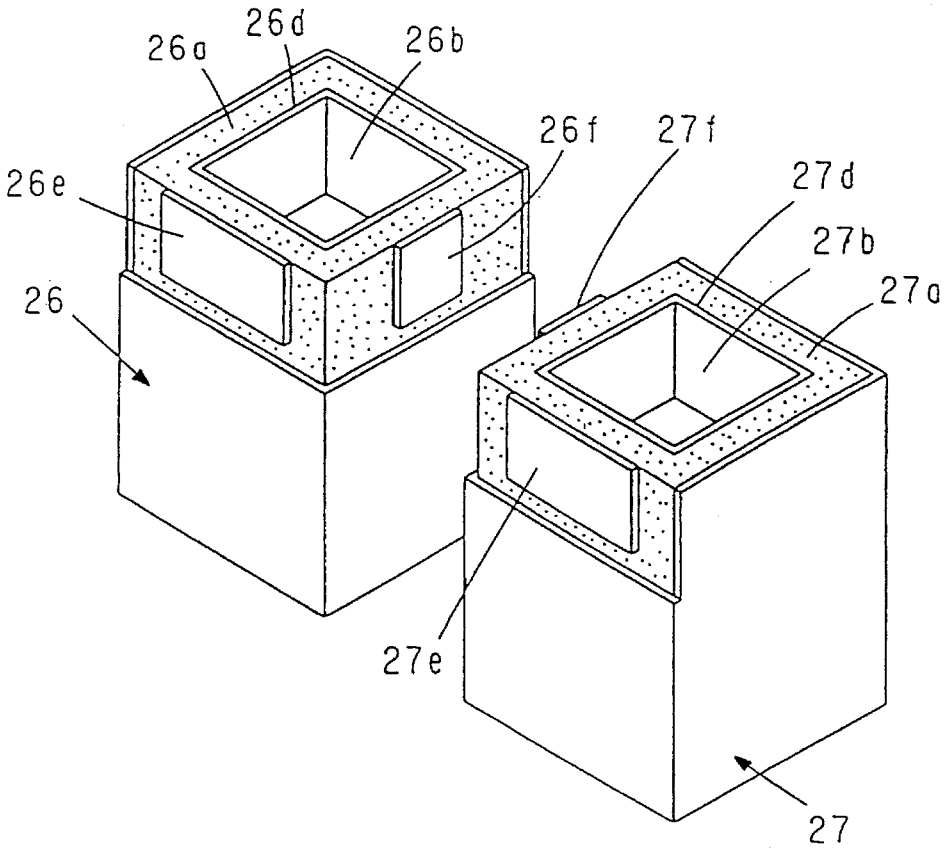
FIG. 11 is an exploded perspective view showing the modified embodiment of the first embodiment of the present invention.

FIG. 10 is a perspective view showing the modified dielectric filter of the first embodiment of the present invention, and FIG. 11 is an exploded perspective view showing the modified dielectric filter of the first embodiment of the present invention.

In FIGS. 10 and 11, reference numerals 26 and 27 represent dielectric resonators whose constructions are almost identical with those of FIGS. 1 and 2 except the configuration of the through hole. First of all, the dielectric resonator 26 will be explained. A reference numeral 26*a* represents a dielectric base body made of dielectric material. The outer configuration of the dielectric base body 26*a* is rectangular parallelopiped having a square cross section. Furthermore, a centrally axially extending through hole is formed in the dielectric base body 26*a*. The through hole consists of a large hole 26*b* and a small hole 26*c* extending centrally and axially and communicated with each other. The large hole 26*b* is positioned near the open end and has a square cross section, while the small hole 26*c* has a circular cross section.

Although the dielectric resonator of FIGS. 1 and 2 has the through hole of constant diameter extending from the open end to the connecting end—from one base to the other base of the rectangular parallelopiped—of the dielectric base body 11*a*, this modified embodiment is different from the embodiment of FIGS. 1 and 2 and characterized in that the through hole has a stepped portion. With this arrangement, an inner conductor 26*d* formed inside the large hole 26*b* can be made large. This means that it becomes possible to increase not only the input/output coupling capacitance between the electrode 26*e* and the inner conductor 26*d* but also the interstage coupling capacitance between the electrodes 28*f* and the inner conductor 26*d*; therefore, it becomes possible to manufacture a wide-band dielectric filter. In the same manner, the other dielectric resonator 27 is formed with a centrally axially extending through hole consisting of a large square hole 27*b* and a small circular hole 27*c*. By providing an inner conductor 27*d* inside this through hole, the input/output coupling capacitance between the electrodes 27*e* and 27*d* can be increased but the interstage coupling capacitance between the electrode 27*f* and the inner conductor 27*d* can be increased.

The remainder of the construction is substantially the same as that of FIGS. 1 and 2.

SECOND EMBODIMENT

Figure 12:
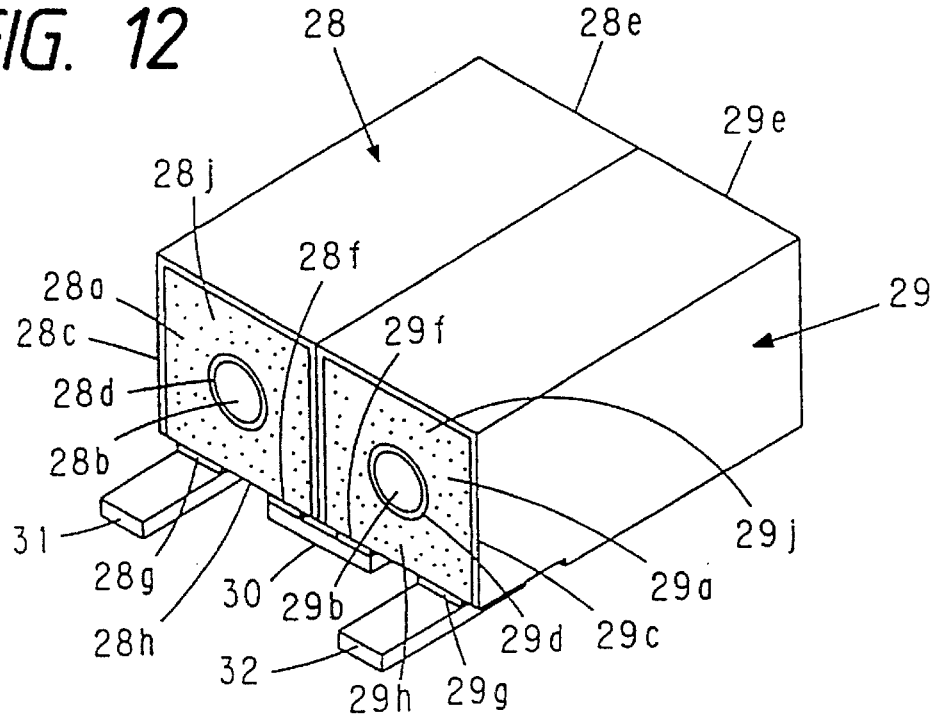
FIG. 12 is a perspective view showing a dielectric filter in accordance with a second embodiment of the present invention.
Figure 13:
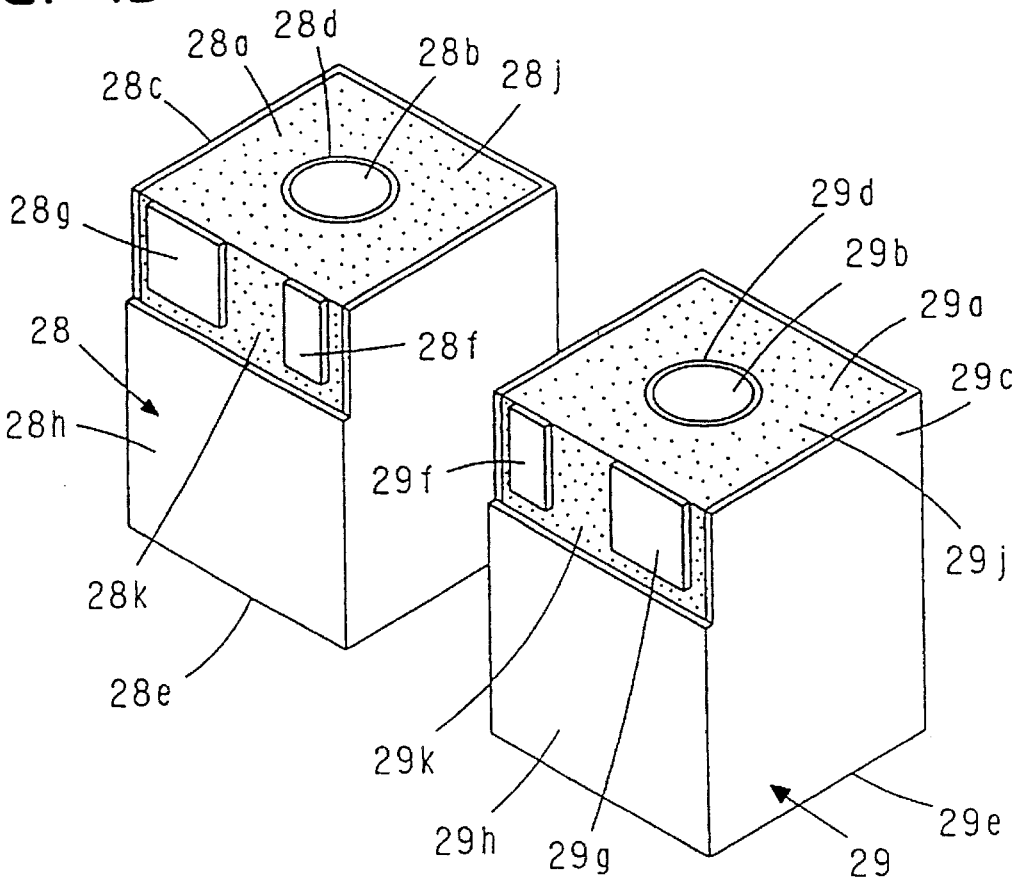
FIG. 13 is an exploded perspective view showing the dielectric filter in accordance with the second embodiment of the present invention.

FIGS. 12 and 13 are perspective and exploded views showing a dielectric filter of the second embodiment of the present invention. In FIGS. 12 and 13, reference numerals 28 and 29 represent dielectric resonators. Hereinafter, taking the dielectric resonator 28 of these two dielectric resonators, a construction of the dielectric resonator will be explained. A dielectric base body 28*a* made of dielectric material, such as $BaO-TiO_2-Nd_2O_3$, $BaO-TiO_2$, $ZrO_2-SnO_2-TiO_2$, $BaO-Sm_2O_3-TiO_2$, is formed with a centrally axially extending through hole 28*b*. The dielectric base body 28*a* has an outer configuration of rectangular parallelopiped having a square cross section, while the through hole 28*b* has a circular cross section.

An outer conductors 28*c* is provided on the outer side surface of the dielectric base body 28*a* so as to surround it. An inner conductor 28*d* is provided along the inner side surface of the through hole 28*b*. The outer conductor 28*c* and the inner conductor 28*d* are connected with each other via a connecting conductor 28*e*. This connecting conductor 28*e* is provided on a closed end surface, i.e. a base of the rectangular parallelopiped, of the dielectric base body 28*a*, in the same manner as the connecting conductor 11*e* the first embodiment explained with reference to FIGS. 35 and 36. Of four outer side surfaces of the dielectric base body 28*a*, one side surface 28*h* is partly cut off so that the dielectric base body 28*a* is bared near the open end 28*j*. Namely, a cutout 28*k* of the outer conductor 28*c* is formed near the open end 28*j* of the dielectric base body 28*a*. Furthermore, an interstage coupling electrode 28*f* is provided within the region of the cutout 28*k*, so that this interstage coupling electrode 28*f* does not contact with other conductors. In the same manner, an input/output coupling electrode 28*g* is provided within the region of the cutout 28*k*, so that this input/output coupling electrode 28*g* does not contact with other conductors.

The arrangement of the interstage coupling electrode 28*f* and the input/output coupling electrode 28*g* is different from that of the first embodiment. Namely, the interstage coupling electrode and the input/output coupling electrode are separately provided on different side surfaces of the dielectric resonator in the first embodiment. On the contrary, the second embodiment provides the cutout 28*k* on only one outer side surface 28*h* and disposes the electrodes 28*f* and 28*g* within the region of this cutout 28*k*.

The other dielectric resonator 29 comprises: a dielectric base body 29*a*, a through hole 29*b*, an outer conductor 29*c*, an inner conductor 29*d*, a connecting conductor 29*e*, an interstage coupling electrode 29*f*, an input/output coupling electrode 29*g*, an outer side surface 29*h*, an open end 29*j*, and a cutout 29*k*. The like parts between the dielectric resonators 28 and 29 are denoted by the same reference alphabet throughout views. (For example, the dielectric base body 28*a* is substantially identical with the dielectric base body 29*a*). However, as apparent from FIG. 13, the relationship between the dielectric resonator 28 and the dielectric resonator 29 are mirror symmetry. Therefore, in production of each dielectric resonator, it is necessary to pay attention to the positional relationship between the electrodes 28*f*, 28*g* and 29*f*, 29*g*.

More specifically, the dielectric resonator 28 and the dielectric resonator 29 are connected by means of, for example, cream solder in such a manner that the outer side surfaces 28*h* and 29*h* do not confront with each other and are placed on the same plane. Furthermore, there is provided a terminal 30 electrically connecting both the electrodes 28*f* and 29*f*. This terminal 30 is made of conductive material, such as silver, copper, and aluminum. Conductive bonding material, such as solder, is used to connect the terminal 30 with the electrodes 28*f*, 29*f*. Furthermore, the electrode 28*g* is connected with a terminal 31 and the electrode 29*g* is connected with a terminal 32 by means of conductive bonding material, such as solder. The terminals 31 and 32 are made of conductive material, such as copper and aluminum.

Furthermore, the outer conductors 28*c*, 29*c*, inner conductors 28*d*, 29*d*, connecting conductors 28*e*, 29*e*, electrodes 28*f*, 29*f*, and electrodes 28*g*, 29*g* (hereinafter, these components are referred to as conductor film) are basically thin film made of conductive material such as copper and silver. The thickness of the film is approximately 5 μm. Although the conductor film is a single layer in this embodiment, it is needless to say that two or more layer structure can be allowed. Regarding the film thickness of approximately 5 μm, this value should be adequately changed depending on the condition of the dielectric filter in service.

Although the electrodes 28*g*, 29*g* and 28*f*, 29*f* are rectangular in this second embodiment, the configuration of these electrodes 28*g*, 29*g* and 28*f*, 29*f* can be any other shape, such as circle, ellipse, and polygon.

As apparent from the foregoing description, the dielectric filter of this embodiment is very simplified and compact in structure. In particular, the present embodiment no longer requires the central conductor and the dielectric substrate of the conventional dielectric filter. This results in 50% reduction of overall size.

Figure 14:
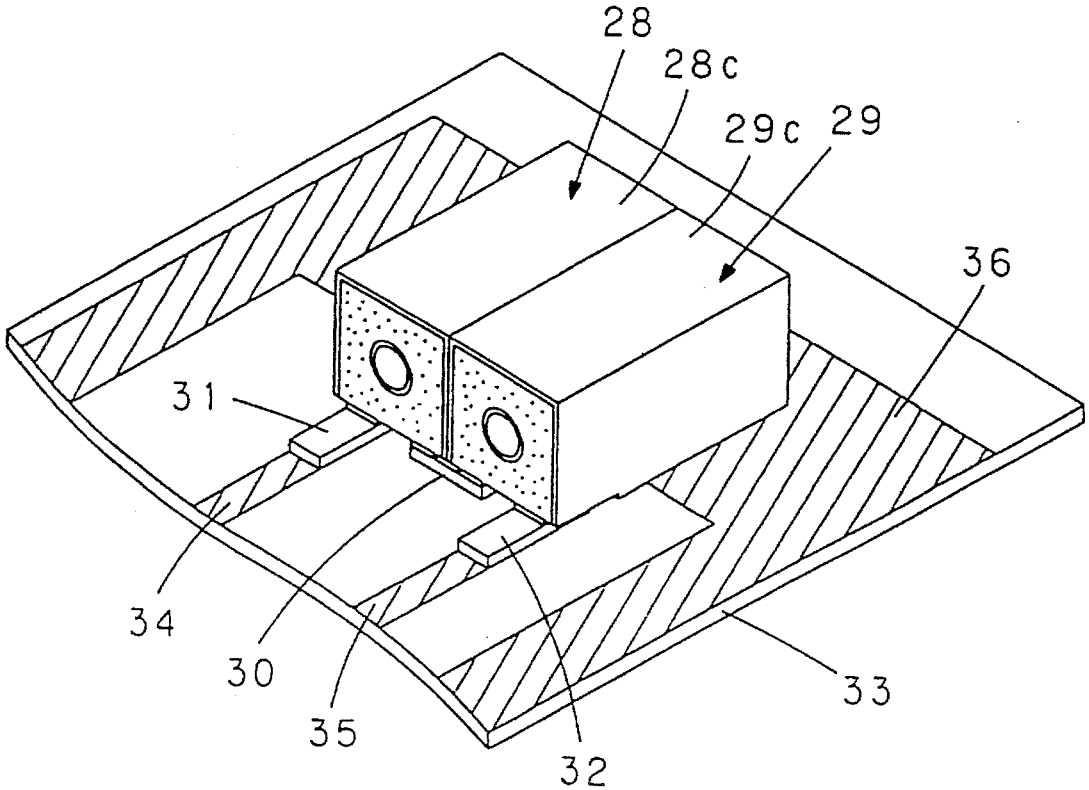
FIG. 14 is a perspective view showing the dielectric filter mounted on a substrate in accordance with the second embodiment of the present invention.

FIG. 14 is a perspective view showing the dielectric filter mounted on a substrate in accordance with the second embodiment of the present invention. In FIG. 14, a reference numeral 33 represents a printed circuit board constituted by insulating material, such as glass epoxy resin. Reference numerals 34 and 35 represent input/output pathways formed on the printed circuit board 33. Similarly, a reference numeral 36 represents a grounded pathway formed on the printed circuit board 33. The terminal 31 of the dielectric resonator 28 is connected onto the input/output pathway 34 by conductive bonding material, such as solder, and the terminal 32 of the dielectric resonator 29 is connected onto the input/output pathway 35 by conductive bonding material, such as solder. Furthermore, the outer conductors 28*c* and 29*c* of the dielectric resonators 28 and 29 are connected onto the grounded pathway 36 by conductive bonding material, such as solder. The input/output pathways 34, 35 and the grounded pathway 36 are formed by coating conductive paste, such as Ag paste, on the printed circuit board 33 in a predetermined pattern and then fixing it by printing. Although this embodiment uses the terminal 30 to connect the electrodes 28*f* and 29*f* and uses the terminals 31 and 32 to connect the input/output pathways and the dielectric filter, it is also possible to provide a connecting electrode on the printed circuit board 33 instead of the terminal 30 to connect the electrodes 28*f* and 29*f*. The terminals 31 and 32 are also omitted in this case.

More specifically, there is provided a connecting electrode (not shown) between the input/output pathways 34, 35 made of conductive material. The dielectric resonators 28 and 29 (being not equipped with the terminals 30, 31 and 32) are placed on the connecting electrode so that both the electrodes 28*f*, 29*f* contact with the connecting electrode, the input/output terminals 28*g*, 29*g* contact with the input/output pathways 34, 35, and the outer conductors 28*c*, 29*c* contact with the grounded conductor 38. Thereafter, the dielectric resonators 28 and 29 are tightly fixed on the printed circuit board by means of conductive bonding material, such as cream solder. In other words, if the terminal 30 is omitted, no gap is generated between the electrodes 28*g*, 29*g* and the printed circuit board 33. Therefore, the terminals 31 and 32 are no longer necessary.

The prospective manufacturing methods of the above-described dielectric filter are substantially the same as those of the previously described first embodiment and, therefore, will be no more explained.

Next, a modified embodiment of the second embodiment will be explained.

Figure 15:
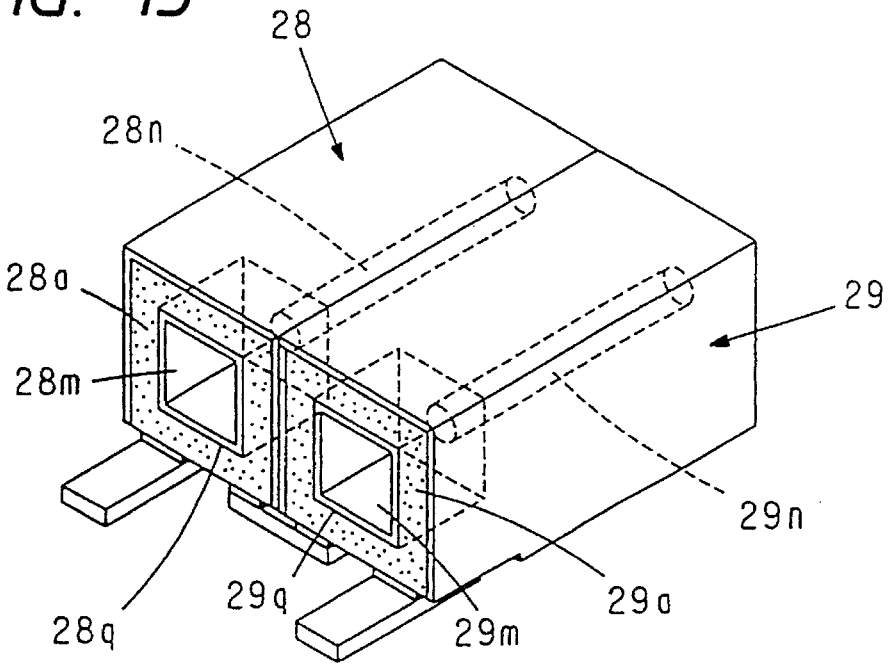
FIG. 15 is a perspective view showing a modified embodiment of the second embodiment of the present invention.
Figure 16:
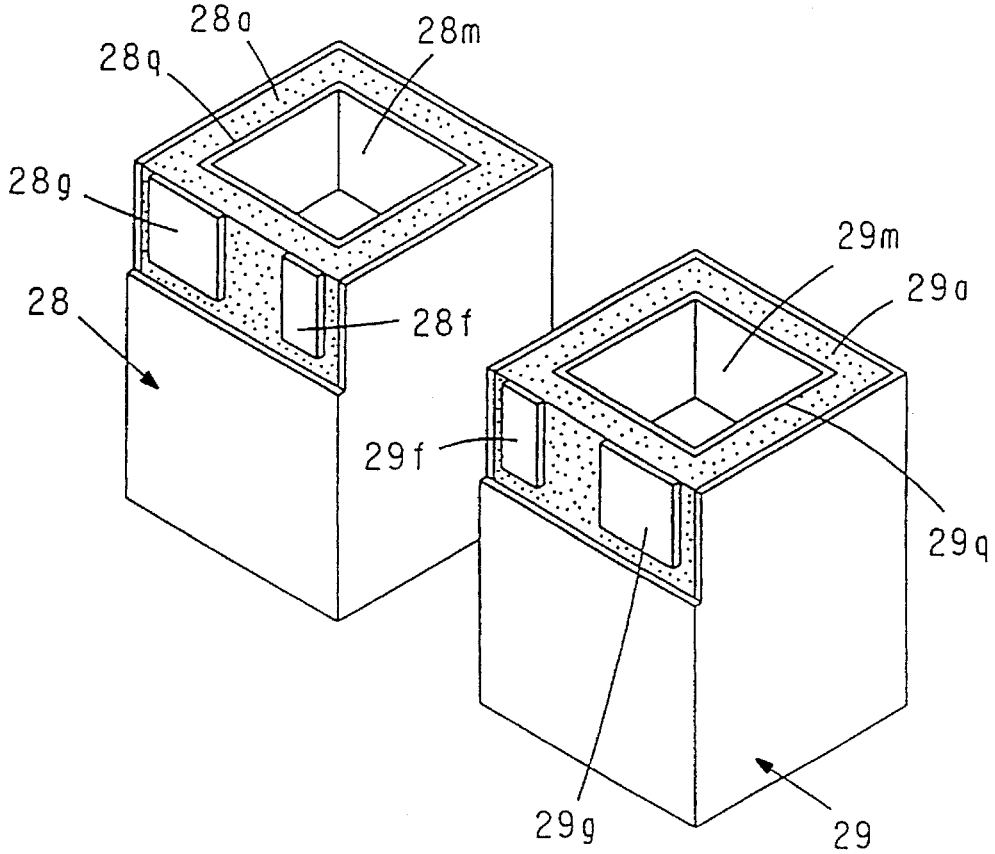
FIG. 16 is an exploded perspective view showing the modified embodiment of the second embodiment of the present invention.

FIG. 15 is a perspective view showing the modified dielectric filter of the second embodiment of the present invention, and FIG. 16 is an exploded perspective view showing the modified dielectric filter of the second embodiment of the present invention.

The modified embodiment of FIGS. 15 and 16 is different from the dielectric filter of FIGS. 12 and 13 in the configuration of a through hole. The dielectric filter of FIGS. 12, 13 has the through hole of constant diameter extending from the open end to the opposite end. On the other hand, this modified dielectric filter is different from the embodiment of FIGS. 12, 13 and characterized in that the through hole has a stepped portion. That is, the dielectric filter 28 has a dielectric base body 28*a* formed with a centrally axially extending through hole. The through hole consists of a large hole 28*m* and a small hole 28*n* extending centrally and axially and communicated with each other. The large hole 28*m* is positioned near the open end and has a square cross section, while the small hole 28*n* has a circular cross section. An inner conductor 28*q* is provided on the inside surface of this through hole. Likewise, the other dielectric filter 29 has a centrally axially extending through hole consisting of a large hole 29*m* and a small hole 29*n* extending centrally and axially and communicated with each other. The large hole 29*m* is positioned near the open end and has a square cross section, while the small hole 29*n* has a circular cross section. An inner conductor 29*q* is provided on the inside surface of this through hole. Providing the stepped portion in the through hole and forming the square holes 28*m*, 29*m* near the open end so as to have a larger cross section than the holes 28*n*, 28*m* is advantageous in increasing not only the input/output coupling capacitance between the electrode 28*g* and the inner conductor 28*q* and between the electrode 29*g* and the inner conductor 29*q* but also the interstage coupling capacitance between the electrode 28*f* and the inner conductor 28*q* and between the electrode 29*f* and the inner conductor 29*q*. Thus, it becomes possible to manufacture a wide-band dielectric filter. The remainder of the construction is substantially the same as that of FIGS. 12 and 13.

THIRD EMBODIMENT

Figure 17:
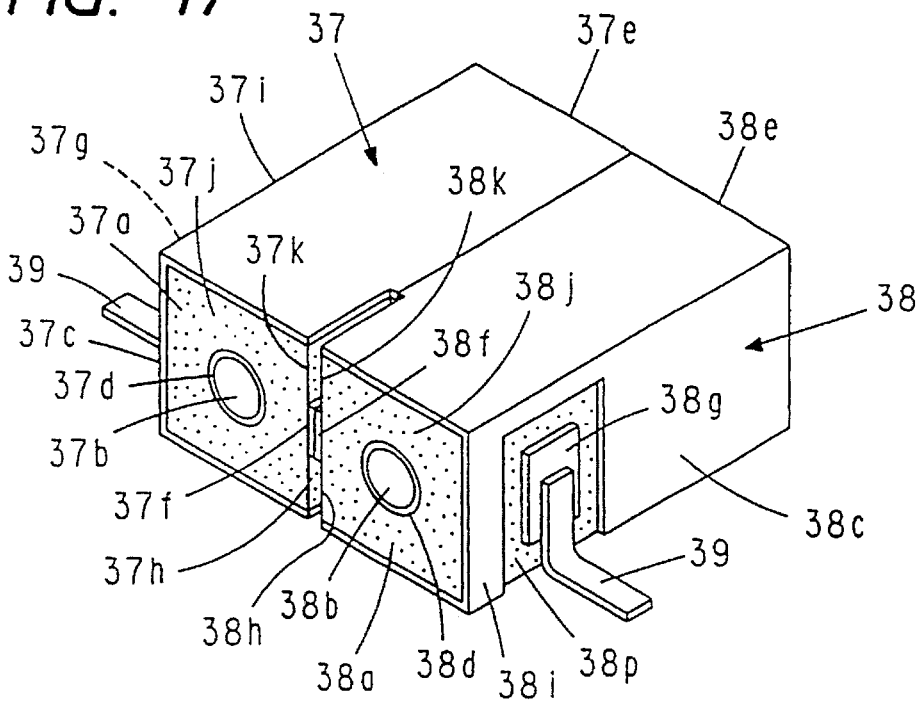
FIG. 17 is a perspective view showing a dielectric filter in accordance with a third embodiment of the present invention.
Figure 18:
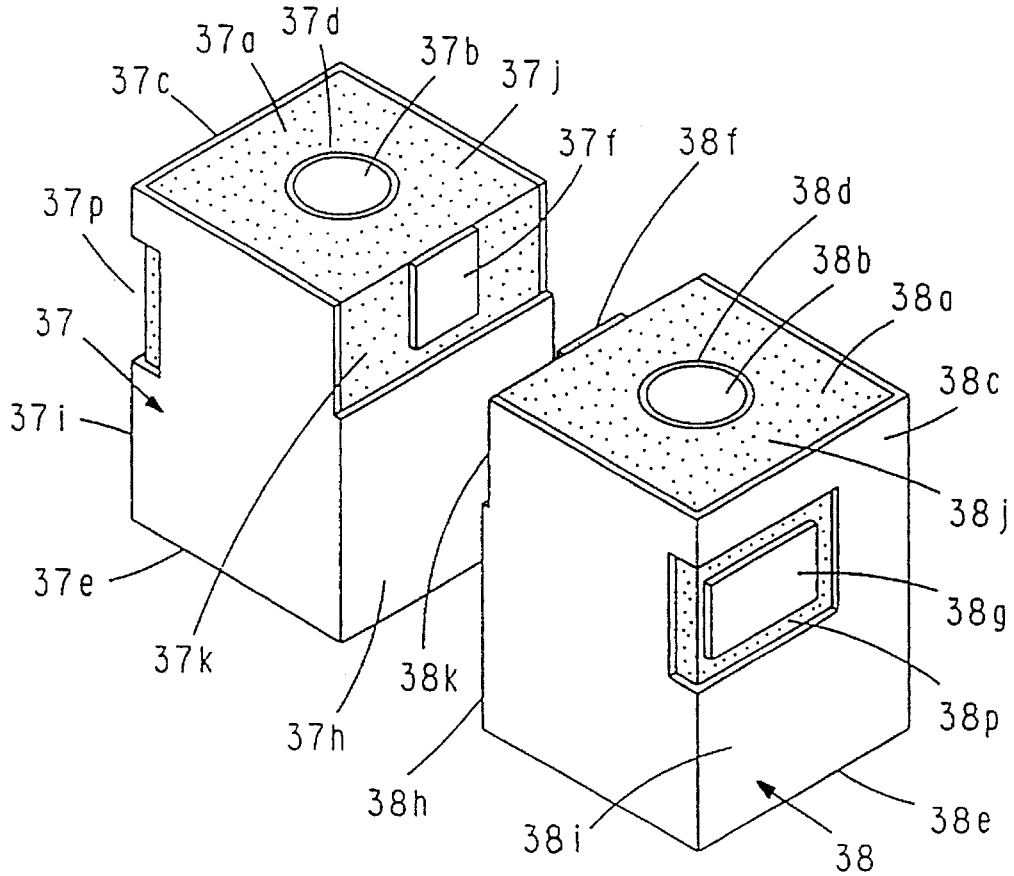
FIG. 18 is an exploded perspective view showing the dielectric filter in accordance with the third embodiment of the present invention.

FIGS. 17 and 18 are perspective and exploded views showing a dielectric filter of the third embodiment of the present invention. In FIGS. 17 and 18, reference numerals 37 and 38 represent dielectric resonators. Hereinafter, taking the dielectric resonator 37 of these two dielectric resonators, a construction of the dielectric resonator will be explained.

A dielectric base body 37*a* made of dielectric material, such as $BaO-TiO_2-Nd_2O_3$, $BaO-TiO_2$, $ZrO_2-SnO_2-TiO_2$, $BaO-Sm_2O_3-TiO_2$, is formed with a centrally axially extending through hole 37*b*.

The dielectric base body 37*a* has an outer configuration of rectangular parallelopiped having a square cross section, while the through hole 37*b* has a circular cross section. An outer conductors 37*c* is provided on the outer side surface of the dielectric base body 37*a* so as to surround it. An inner conductor 37*d* is provided along the inner side surface of the through hole 37*b*. The outer conductor 37*c* and the inner conductor 37*d* are connected with each other via a connecting conductor 37*e*. This connecting conductor 37*e* is provided on a closed end surface, i.e. a base of the rectangular parallelopiped, of the dielectric base body 37*a* as explained in the first embodiment with reference to FIGS. 35 and 36. Of four outer side surfaces of the dielectric base body 37*a*, two side surfaces 37*i* and 37*h* are partly cut off so that the dielectric base body 37*a* is bared near the open end 37*j*. Namely, cutouts 37*p* and 37*k* of the outer conductor 37*c* are formed on the two side surfaces 37*i* and 37*h*, respectively, near the open end 37*j* of the dielectric base body 37*a*.

Furthermore, an interstage coupling electrode 37*f* is provided within the region of the cutout 37*k* on the outer side surface 37*h*, so that this interstage coupling electrode 37*f* does not contact with other conductors. In the same manner, an input/output coupling electrode (not shown) is provided within the region of the cutout 37*p* on the outer side surface 37*i*, so that this input/output coupling electrode does not contact with other conductors. The cutout 37*p* extends beyond the corner and along an adjacent outer side surface—a surface to be confronted with the printed circuit board. It will be preferable to connect an L-shaped terminal 39 with the input/output coupling electrode. Namely, depending on the condition of the printed circuit board on which the dielectric filter is mounted, the terminal 39 and others are connected with the input/output coupling electrode. Then, the terminal 39 is firmly connected with a conductive film (e.g. input/output pathway) on the printed circuit board by means of solder or the like. Instead of providing the terminal 39, it will be also possible to directly connect the input/output coupling electrode with the conductive film on the printed circuit board by means of solder or the like. For the latter case, the cutout 37*p* extending within the region of the surface to be confronted with the printed circuit board serves to prevent the solder electrically connecting the conductive film and the input/output coupling electrode from contacting with the outer conductor 37*c*.

Likewise, the other dielectric resonator 38 comprises: a dielectric base body 38*a*, a through hole 38*b*, an outer conductor 38*c*, an inner conductor 38*d*, a connecting conductor 38*e*, an interstage coupling electrode 38*f*, an input/output coupling electrode 38*g* (which is similar to the input/output coupling electrode of the dielectric resonator 37), outer side surfaces 38*h* and 38*i*, an open end 38*j*, and cutouts 38*k*, 38*p*. The like parts between the dielectric resonators 37 and 38 are denoted by the same reference alphabet throughout views. (For example, the dielectric base body 37*a* is substantially identical with the dielectric base body 38*a*).

However, as apparent from FIG. 18, the relationship between the dielectric resonator 37 and the dielectric resonator 38 are mirror symmetry. Therefore, in production of each dielectric resonator, it is necessary to pay attention to the positional relationship between the electrodes 37*f*, 37*g* and 38*f*, 38*g*.

Furthermore, the electrode 38*g* may be connected with a terminal 39 depending on the condition of the printed circuit board on which the dielectric resonator 38 is mounted, in the same manner as the dielectric resonator 37.

More specifically, the dielectric resonator 37 and the dielectric resonator 38 are connected by means of, for example, cream solder in such a manner that the electrodes 37*f* and 38*f* confront and contact with each other and the electrodes 37*g* and 38*g* are placed in parallel and remotely opposed relationship so as to face both sides of the resonators. This is because these dielectric resonators are disposed in mirror symmetry relationship as described before.

Furthermore, the outer conductors 37*c*, 38*c*, inner conductors 37*d*, 38*d*, connecting conductors 37*e*, 38*e*, electrodes 37*f*, 38*f*, and electrodes 37*g*, 38*g* (hereinafter, these components are referred to as conductor film) are basically thin film made of conductive material such as copper and silver. The thickness of the film is approximately 5 μm. Although the conductor film is a single layer in this embodiment, it is needless to say that two or more layer structure can be allowed. Regarding the film thickness of approximately 5 μm, this value should be adequately changed depending on the condition of the dielectric filter in service.

Although the electrodes 37*g*, 38*g* and 37*f*, 38*f* are rectangular in this third embodiment, the configuration of these electrodes 37*g*, 38*g* and 37*f*, 38*f* can be any other shape, such as circle, ellipse, and polygon.

As apparent from the foregoing description, the dielectric filter of this embodiment is very simplified and compact in structure. In particular, the present embodiment no longer requires the central conductor and the dielectric substrate of the conventional dielectric filter. This results in 50% reduction of overall size.

Figure 19:
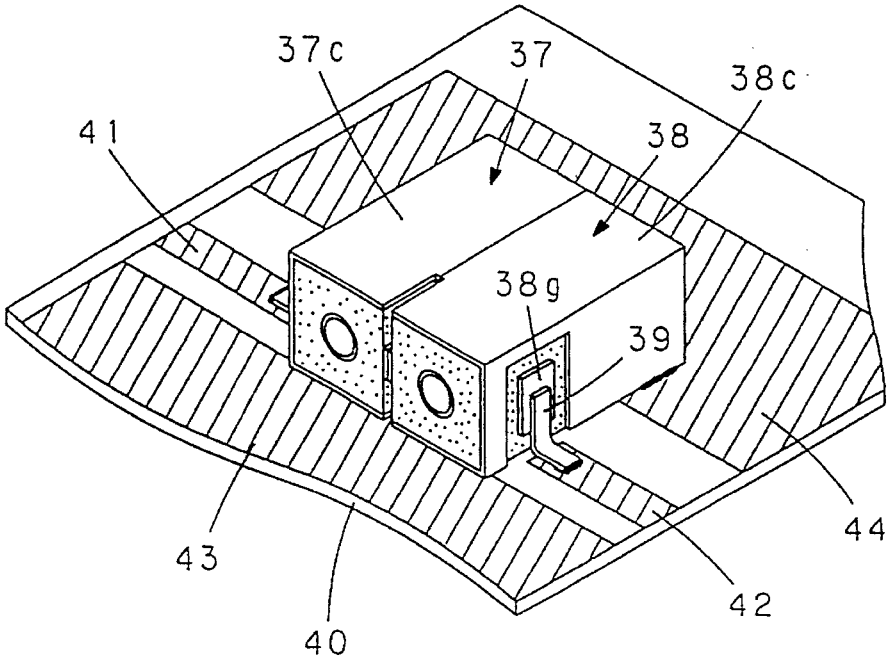
FIG. 19 is a perspective view showing the dielectric filter mounted on a substrate in accordance with the third embodiment of the present invention.
Figure 20:
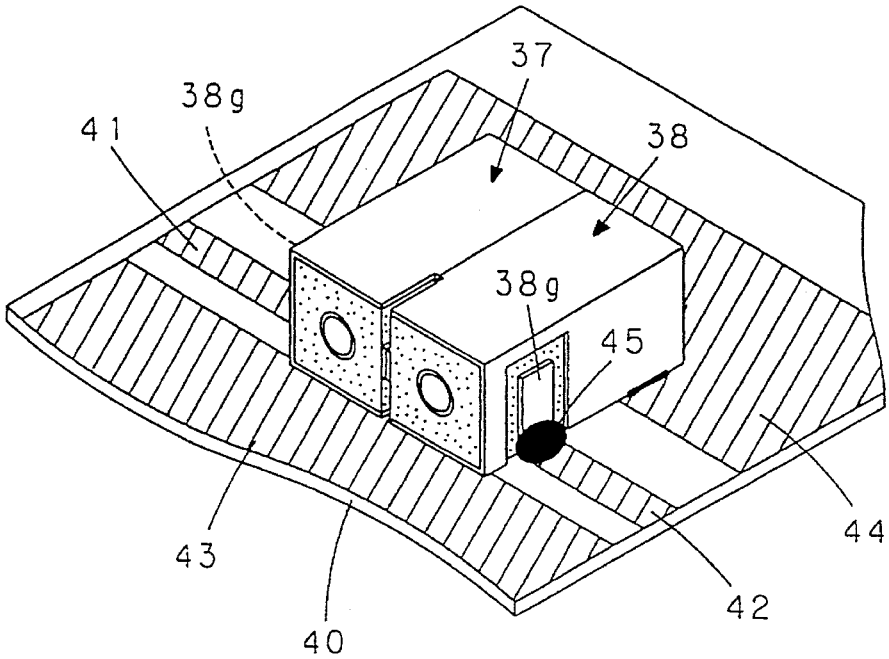
FIG. 20 is a perspective view showing the dielectric filter mounted on a substrate in accordance with the third embodiment of the present invention.

FIGS. 19 and 20 are perspective views showing the dielectric filter mounted on a substrate in accordance with the third embodiment of the present invention. In FIG. 19, a reference numeral 40 represents a printed circuit board constituted by insulating material, such as glass epoxy resin. Reference numerals 41 and 42 represent input/output pathways formed on the printed circuit board 40. Similarly, reference numerals 43, 44 represent grounded pathways formed on the printed circuit board 40 so as to sandwich the input/output pathways 41, 42, respectively. The terminal 39, connected to the input/output coupling electrode 37*g* of the dielectric resonator 37, is connected onto the input/output pathway 41 by conductive bonding material, such as solder. And the terminal 39, connected to the electrode 38*g* of the dielectric resonator 38 is connected onto the input/output pathway 42 by conductive bonding material, such as solder. Furthermore, the outer conductors 37*c* and 38*b* of the dielectric resonators 37 and 38 are connected onto the grounded pathways 43, 44, respectively, by conductive bonding material, such as solder. The input/output pathways 41, 42 and the grounded pathways 43, 44 are formed by coating conductive paste, such as Ag paste, on the printed circuit board 40 in a predetermined pattern and then fixing it by printing.

Furthermore, as shown in FIG. 20, the terminal 39 can be omitted. Namely, in mounting the dielectric filter onto the printed circuit board 40, the input/output coupling electrode 37*g* of the dielectric resonator 37 and the electrode 38*g* of the dielectric resonator 38 can be directly connected with the input/output pathways 41 and 42 by means of a conductive bonding material 45, such as solder. In this case, the conductive bonding material 45 should be spaced from the outer conductor 38*g* (as the outer conductor 37*g* of the dielectric resonator 37 is spaced from the conductive material).

The prospective manufacturing methods of the above-described dielectric filter are substantially the same as those of the previously described first embodiment and, therefore, will be no more explained.

Figure 21:
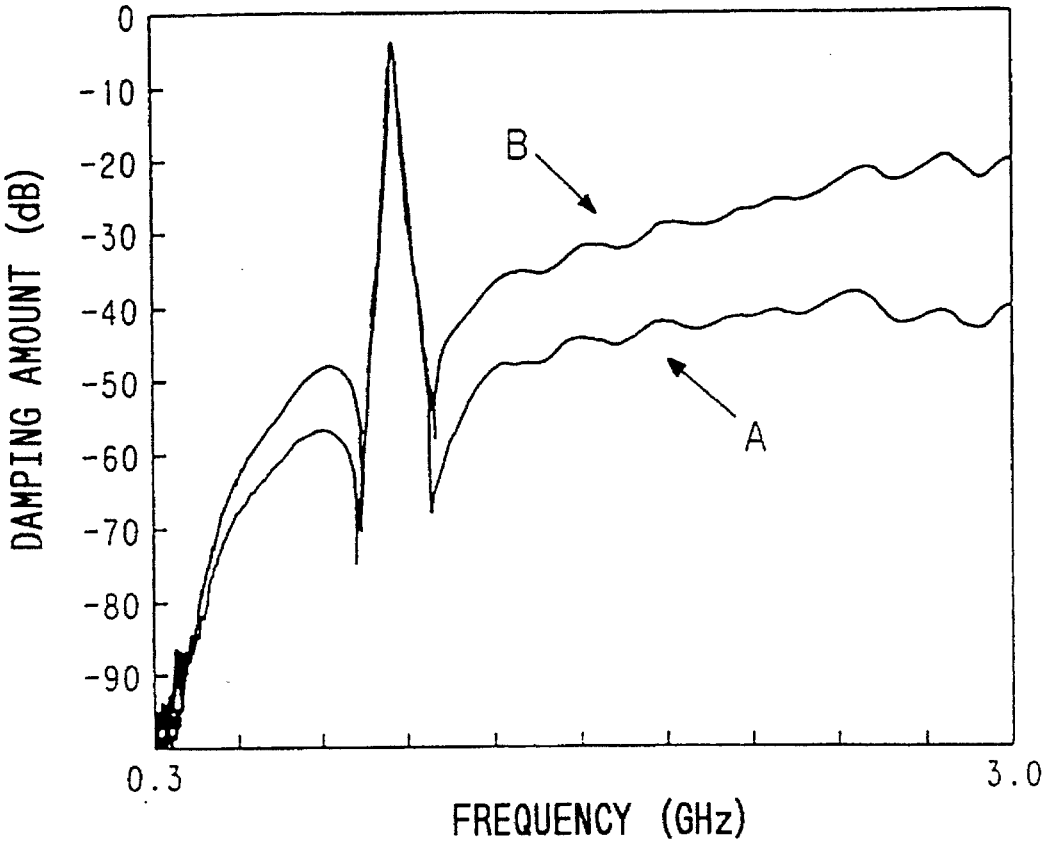
FIG. 21 is a graph showing the comparison of damping characteristics outside the band with respect to frequencies between the first and third embodiments.

FIG. 21 shows a graph showing the comparison of damping characteristics outside the band with respect to frequencies between the first and third embodiments. In FIG. 21, a curve A represents the damping characteristics of the third embodiment and a curve B represents the damping characteristics of the first embodiment. As understood from FIG. 21, the third embodiment can improve the damping amount outside the band.

In the same manner as the first and second embodiments, the third embodiment can form the through holes provided in the dielectric base bodies 37*a*, 38*a* to have a stepped portion as shown in FIG. 15. With this arrangement, the input/output coupling capacitance can be increased and also the interstage coupling capacitance can be enlarged. Thus, it becomes possible to obtain a wide-band dielectric filter.

The remainder of the construction is substantially the same as that of FIGS. 17 and 18.

FOURTH EMBODIMENT

Figure 22:
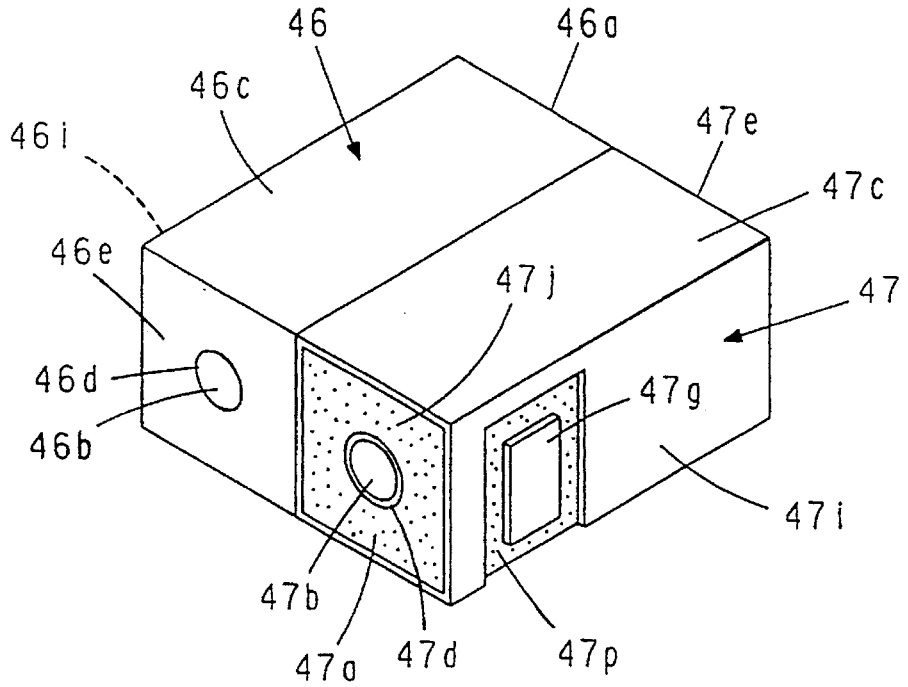
FIG. 22 is a perspective view showing a dielectric filter in accordance with a fourth embodiment of the present invention.
Figure 23:
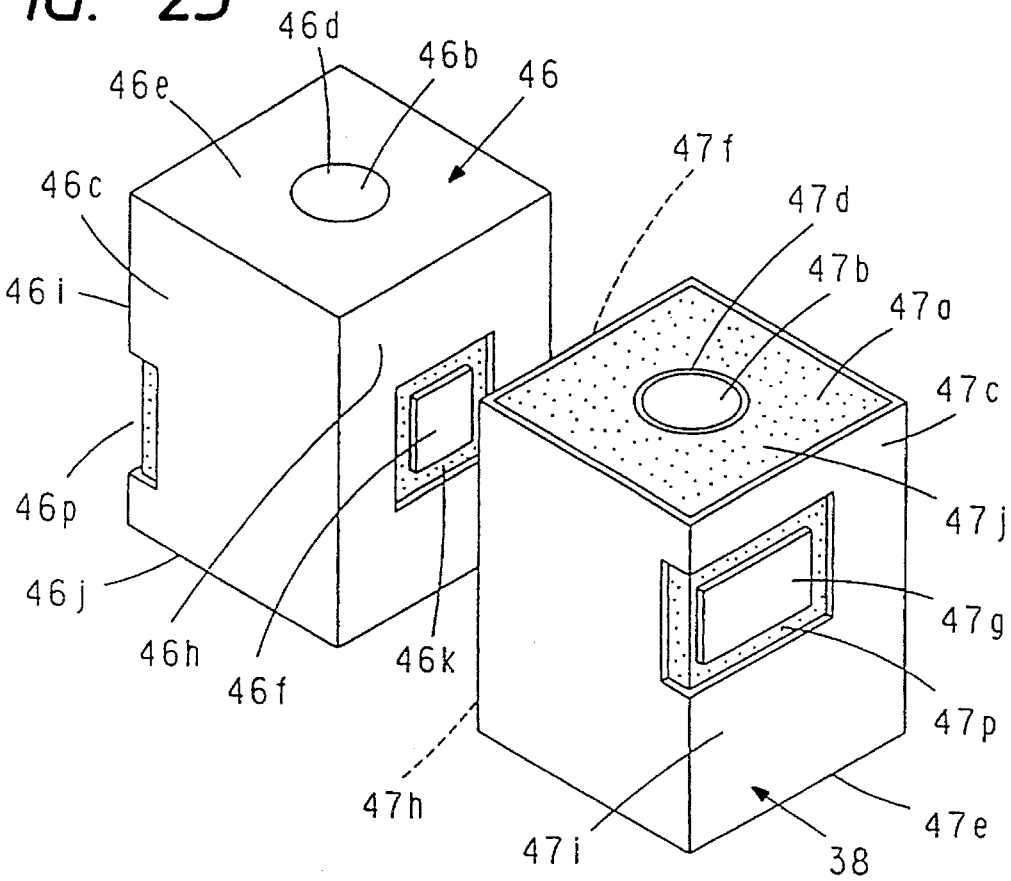
FIG. 23 is an exploded perspective view showing the dielectric filter in accordance with the fourth embodiment of the present invention.

FIGS. 22 and 23 are perspective and exploded views showing a dielectric filter of the fourth embodiment of the present invention. In FIGS. 22 and 23, reference numerals 46 and 47 represent dielectric resonators. Hereinafter, taking the dielectric resonator 46 of these two dielectric resonators, a construction of the dielectric resonator will be explained. A dielectric base body 46*a* made of dielectric material, such as $BaO\text{-}TiO_2\text{-}Nd_2O_3$, $BaO\text{-}TiO_2$, $ZrO_2\text{-}SnO_2\text{-}TiO_2$, $BaO\text{-}Sm_2O_3\text{-}TiO_2$, is formed with a centrally axially extending through hole 46*b*. The dielectric base body 46*a* has an outer configuration of rectangular parallelopiped having a square cross section, while the through hole 46*b* has a circular cross section. An outer conductors 46*c* is provided on the outer side surface of the dielectric base body 46*a* so as to surround it. An inner conductor 46*d* is provided along the inner side surface of the through hole 46*b*. The outer conductor 46*c* and the inner conductor 46*d* are connected with each other via a connecting conductor 46*e*. This connecting conductor 46*e* is provided on a closed end surface, i.e. a base of the rectangular parallelopiped, of the dielectric base body 46*a* as explained in the first embodiment with reference to FIGS. 35 and 36. Of four outer side surfaces of the dielectric base body 46*a*, two side surfaces 46*i* and 46*h* are partly cut off so that the dielectric base body 46*a* is bared near the open end 46*j*. Namely, cutouts 46*p* and 46*k* of the outer conductor 46*c* are formed on the two side surfaces 46*i* and 46*h*, respectively, near the open end 46*j* of the dielectric base body 46*a*.

Furthermore, an interstage coupling electrode 46*f* is provided within the region of the cutout 46*k* on the outer side surface 46*h*, so that this interstage coupling electrode 46*f* does not contact with other conductors. In the same manner, an input/output coupling electrode (not shown) is provided within the region of the cutout 46*p* on the outer side surface 46*i*, so that this input/output coupling electrode does not contact with other conductors. The cutout 46*p* extends beyond the corner and along an adjacent outer side surface—a surface to be confronted with the printed circuit board. It will be preferable to connect an L-shaped terminal with the input/output coupling electrode. Namely, depending on the condition of the printed circuit board on which the dielectric filter is mounted, the terminal and others are connected with the input/output coupling electrode. Then, the terminal is firmly connected with a conductive film (e.g. input/output pathway) on the printed circuit board by means of solder or the like. Instead of providing the terminal, it will be also possible to directly connect the input/output coupling electrode with the conductive film on the printed circuit board by means of solder or the like. For the latter case, the cutout 46*p* extending within the region of the surface to be confronted with the printed circuit board serves to prevent the solder electrically connecting the conductive film and the input/output coupling electrode from contacting with the outer conductor 46*c*.

Likewise, the other dielectric resonator 47 comprises: a dielectric base body 47*a*, a through hole 47*b*, an outer conductor 47*c*, an inner conductor 47*d*, a connecting conductor 47*e*, an interstage coupling electrode (which is similar to the interstage coupling electrode 46*f* of the dielectric resonator 46), an input/output coupling electrode 47*g* (which is similar to the input/output coupling electrode of the dielectric resonator 46), outer side surfaces 47*h* and 47*i*, an open end 47*j*, and cutouts 47*k*, 47*p*. The like parts between the dielectric resonators 46 and 47 are denoted by the same reference alphabet throughout views. (For example, the dielectric base body 46*a* is substantially identical with the dielectric base body 47*a*) Furthermore, the electrode 47*g* may be connected with a terminal depending on the condition of the printed circuit board on which the dielectric resonator 47 is mounted, in the same manner as the dielectric resonator 46.

More specifically, the dielectric resonator 46 and the dielectric resonator 47 are connected by means of, for example, cream solder in such a manner that the electrodes 46*f* and 47*f* confront and contact with each other and the input/output coupling electrodes 47*g* are placed in parallel and remotely opposed relationship so as to face both sides of the resonators. Furthermore, the dielectric resonators 46 and 47 are placed in opposed relationship so that respective open ends thereof face opposite directions.

Furthermore, the outer conductors 46*c*, 47*c*, inner conductors 46*d*, 47*d*, connecting conductors 46*e*, 47*e*, electrode 46*f* as well as the interstage coupling electrode of the dielectric resonator 47, and electrode 47*g* as well as the input/output coupling electrode of the dielectric resonator 46 (hereinafter, these components are referred to as conductor film) are basically thin film made of conductive material such as copper and silver. The thickness of the film is approximately 5 μm. Although the conductor film is a single layer in this embodiment, it is needless to say that two or more layer structure can be allowed. Regarding the film thickness of approximately 5 μm, this value should be adequately changed depending on the condition of the dielectric filter in service.

Although the electrode 47*g* (as well as the input/output coupling electrode of the dielectric resonator 46) and the electrode 46*f* (as well as the interstage coupling electrode of the dielectric resonator 47) are rectangular in this embodiment, the configuration of these electrodes can be any other shape, such as circle, ellipse, and polygon.

As apparent from the foregoing description, the dielectric filter of this embodiment is very simplified and compact in structure. In particular, the present embodiment no longer requires the central conductor and the dielectric substrate of the conventional dielectric filter. This results in 50% reduction of overall size.

In the same manner as the first and second embodiments, this embodiment can form the through hole to have a stepped portion as shown in FIG. 15. With this arrangement, the input/output coupling capacitance can be increased and also the interstage coupling capacitance can be enlarged. Thus, it becomes possible to obtain a wide-band dielectric filter.

The remainder of the construction is substantially the same as that of FIGS. 17 and 18.

VARIATIONS OF FIRST TO FOURTH EMBODIMENTS

Figure 24:
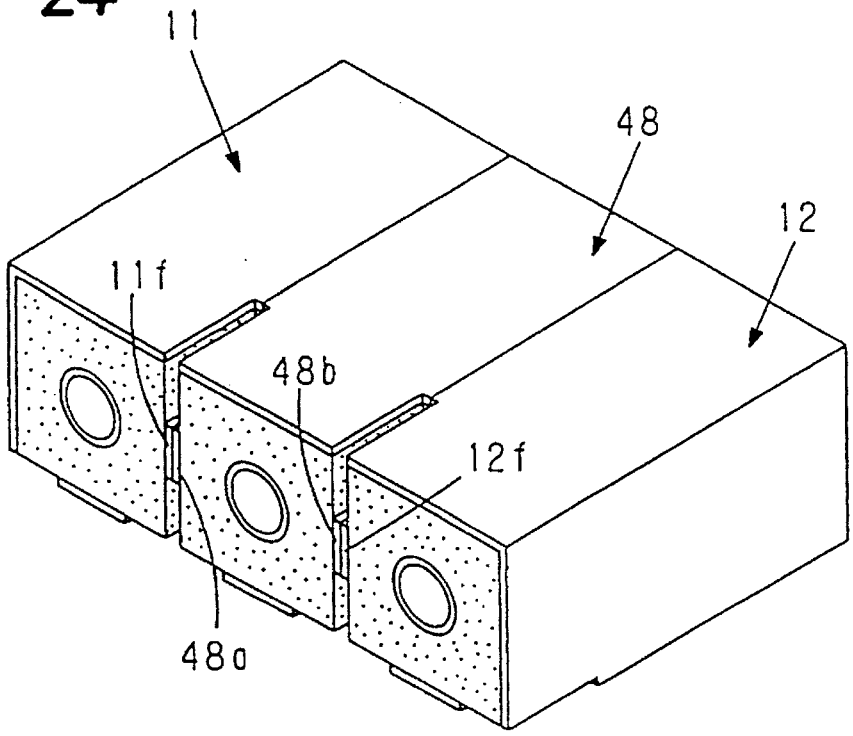
FIG. 24 is a perspective view showing a modified dielectric filter of the first embodiment, wherein three dielectric resonators are included.
Figure 25:
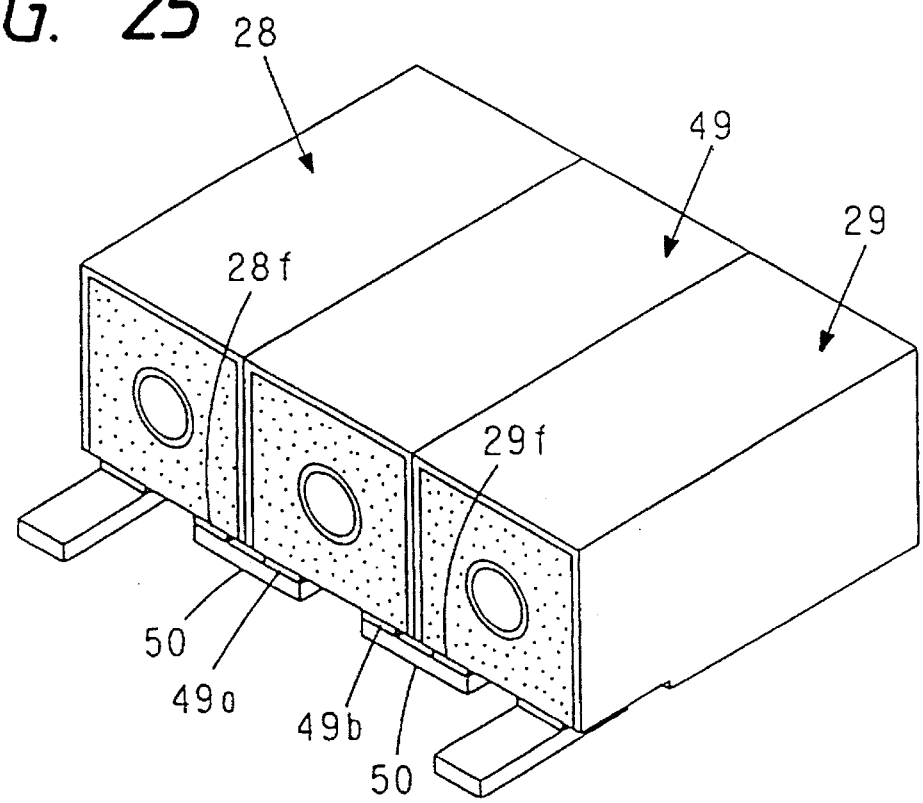
FIG. 25 is a perspective view showing a modified dielectric filter of the second embodiment, wherein three dielectric resonators are included.
Figure 26:
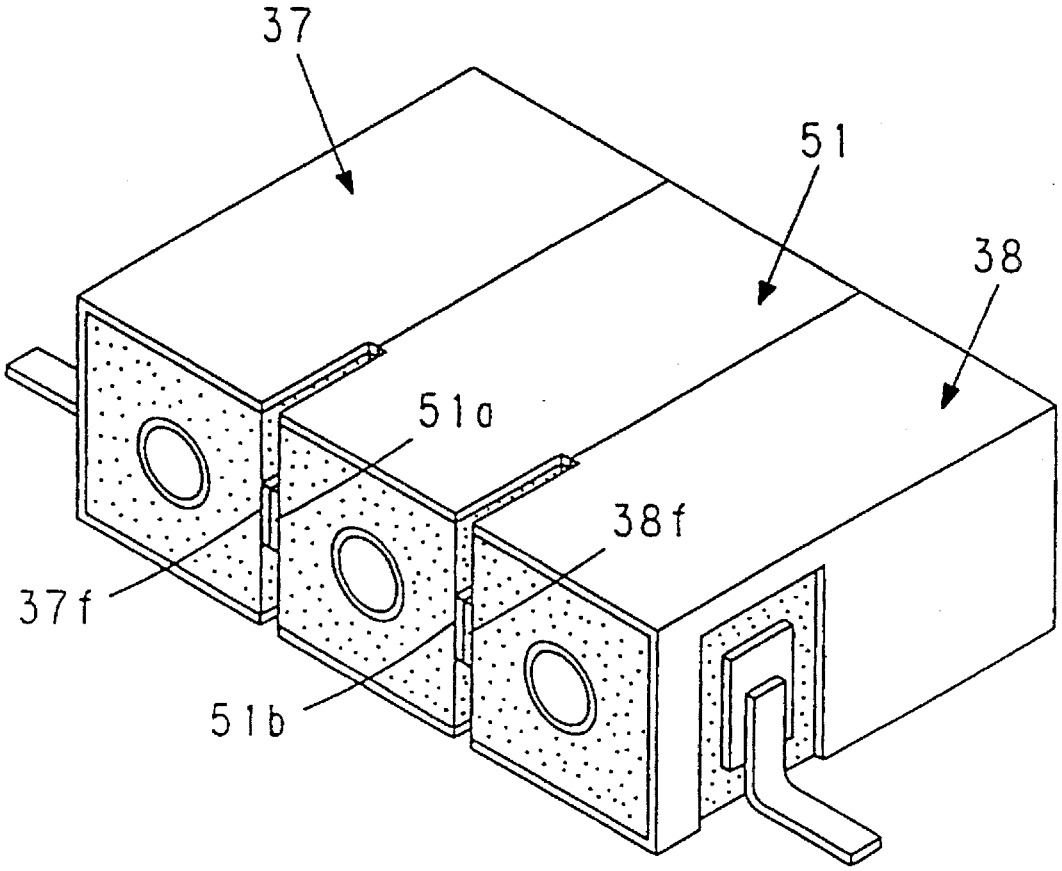
FIG. 26 is a perspective view showing a modified dielectric filter of the third embodiment, wherein three dielectric resonators are included.
Figure 27:
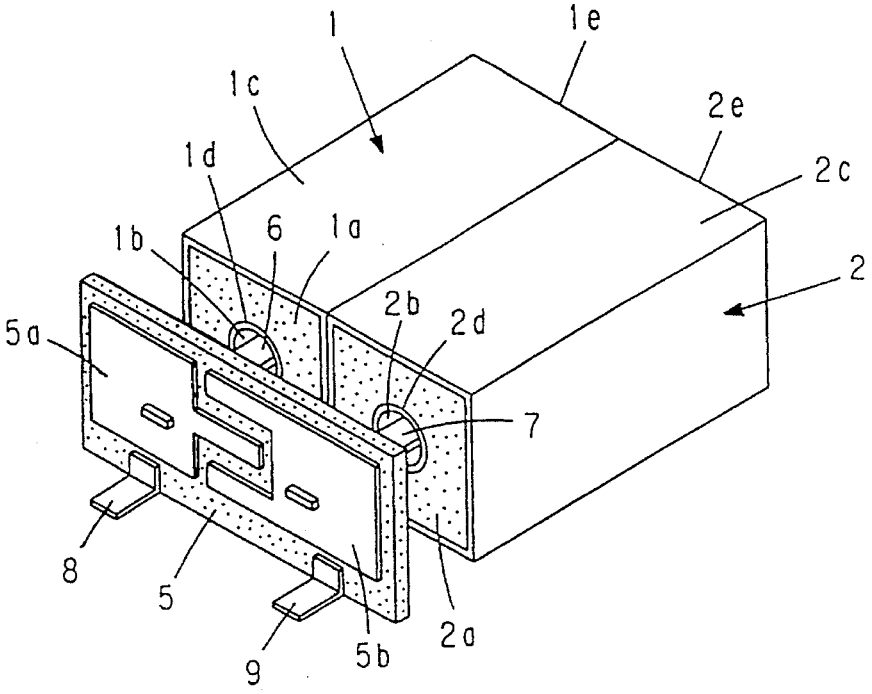
FIG. 27 PRIOR ART
FIG. 27 is a perspective view showing a conventional dielectric filter.
Figure 28A:
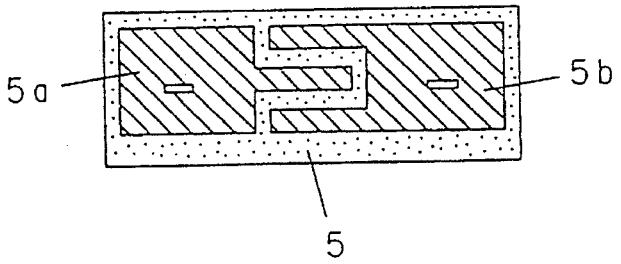
FIG. 28A PRIOR ART
FIG. 28(A) is a front view showing a coupling substrate of the conventional dielectric filter.
Figure 28B:
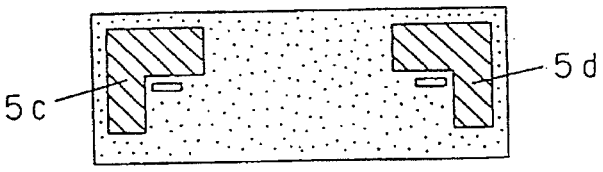
FIG. 28B PRIOR ART
FIG. 28(B) is a rear view showing a coupling substrate of the conventional dielectric filter.

Although the above first to fourth embodiments are explained based on a dielectric filter consisting of two dielectric resonators, the same effect will be obtained even if more than two dielectric resonators are assembled as shown in FIGS. 24, 25 and 26.

FIG. 24 is a perspective view showing a modified dielectric filter of the first embodiment, wherein three dielectric resonators are assembled. In FIG. 24, reference numerals 11 and 12 represent dielectric resonators having the same construction as the above-described first embodiment. A reference numeral 48 represents a dielectric resonator interposed between the dielectric resonators 11 and 12. The dielectric resonator 48 has interstage coupling electrodes 48*a*, 48*b* on the opposite outer side surfaces and has no input/output coupling electrode. The electrode 48*a* is connected with the interstage coupling electrode 11*f* of the dielectric resonator 11, and the electrode 48*b* is connected with the interstage coupling electrode 12*f* of the dielectric resonator 12. In this manner, when the dielectric filter includes not less than three resonators, the dielectric resonators equipped with both interstage and input/output coupling electrodes (hereinafter referred to as end resonators) are placed at both ends. Then, one or more dielectric resonators equipped with only interstage coupling electrodes (hereinafter referred to as interstage resonators) are interposed in series between the two end resonators, so that mutually confronting interstage coupling electrodes are connected one another. With this arrangement, the dielectric filter of the first embodiment can include not less than three dielectric resonators.

FIG. 25 is a perspective view showing a modified dielectric filter of the second embodiment, wherein three dielectric resonators are assembled. In FIG. 25, reference numerals 28 and 29 represent dielectric resonators having the same construction as the above-described second embodiment. A reference numeral 49 represents a dielectric resonator interposed between the dielectric resonators 28 and 29. The dielectric resonator 49 has interstage coupling electrodes 49*a*, 49*b* on the same outer side surface and has no input/output coupling electrode. The electrode 49*a* is connected with the interstage coupling electrode 28*f* of the dielectric resonator 28 through a terminal 50, and the electrode 49*b* is connected with the interstage coupling electrode 29*f* of the dielectric resonator 29 through another terminal 50. In this manner, when the dielectric filter includes not less than three resonators, the dielectric resonators equipped with both interstage and input/output coupling electrodes (hereinafter referred to as end resonators) are placed at both ends. Then, one or more dielectric resonators equipped with only interstage coupling electrodes (hereinafter referred to as interstage resonators) are interposed in series between the two end resonators, so that mutually confronting interstage coupling electrodes are connected one another. With this arrangement, the dielectric filter of the second embodiment can include not less than three dielectric resonators.

FIG. 26 is a perspective view showing a modified dielectric filter of the third embodiment, wherein three dielectric resonators are assembled. In FIG. 26, reference numerals 37 and 38 represent dielectric resonators having the same construction as the above-described third embodiment. A reference numeral 51 represents a dielectric resonator interposed between the dielectric resonators 37 and 38. The dielectric resonator 51 has interstage coupling electrodes 51*a*, 51*b* on the opposite outer side surfaces and has no input/output coupling electrode. The electrode 51*a* is connected with the interstage coupling electrode 37*f* of the dielectric resonator 37, and the electrode 51*b* is connected with the interstage coupling electrode 38*f* of the dielectric resonator 38. In this manner, when the dielectric filter includes not less than three resonators, the dielectric resonators equipped with both interstage and input/output coupling electrodes (hereinafter referred to as end resonators) are placed at both ends. Then, one or more dielectric resonators equipped with only interstage coupling electrodes (hereinafter referred to as interstage resonators) are interposed in series between the two end resonators, so that mutually confronting interstage coupling electrodes are connected one another. With this arrangement, the dielectric filter of the third embodiment can include not less than three dielectric resonators.

In the same manner, the dielectric filter of the fourth embodiment can include not less than four resonators by interposing one or more interstage resonators between two end resonators.

FIFTH EMBODIMENT

Figure 29:
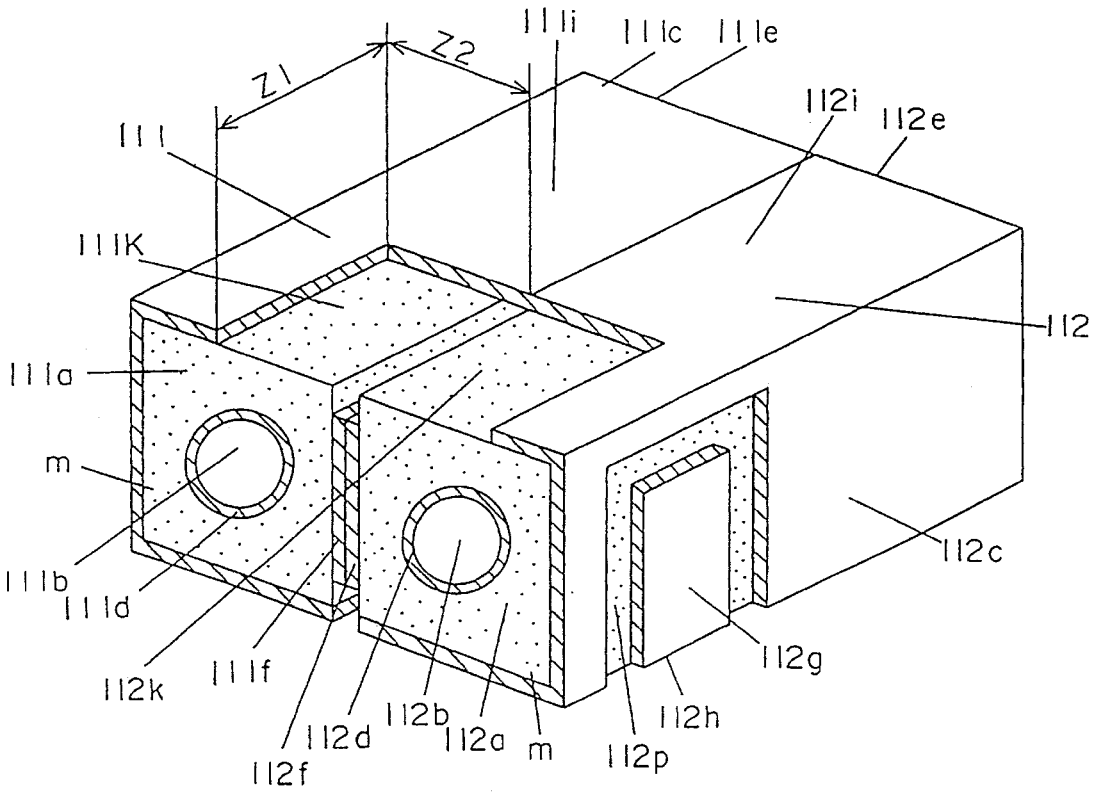
FIG. 29 is a perspective view showing a dielectric filter in accordance with a fifth embodiment of the present invention.
Figure 30:
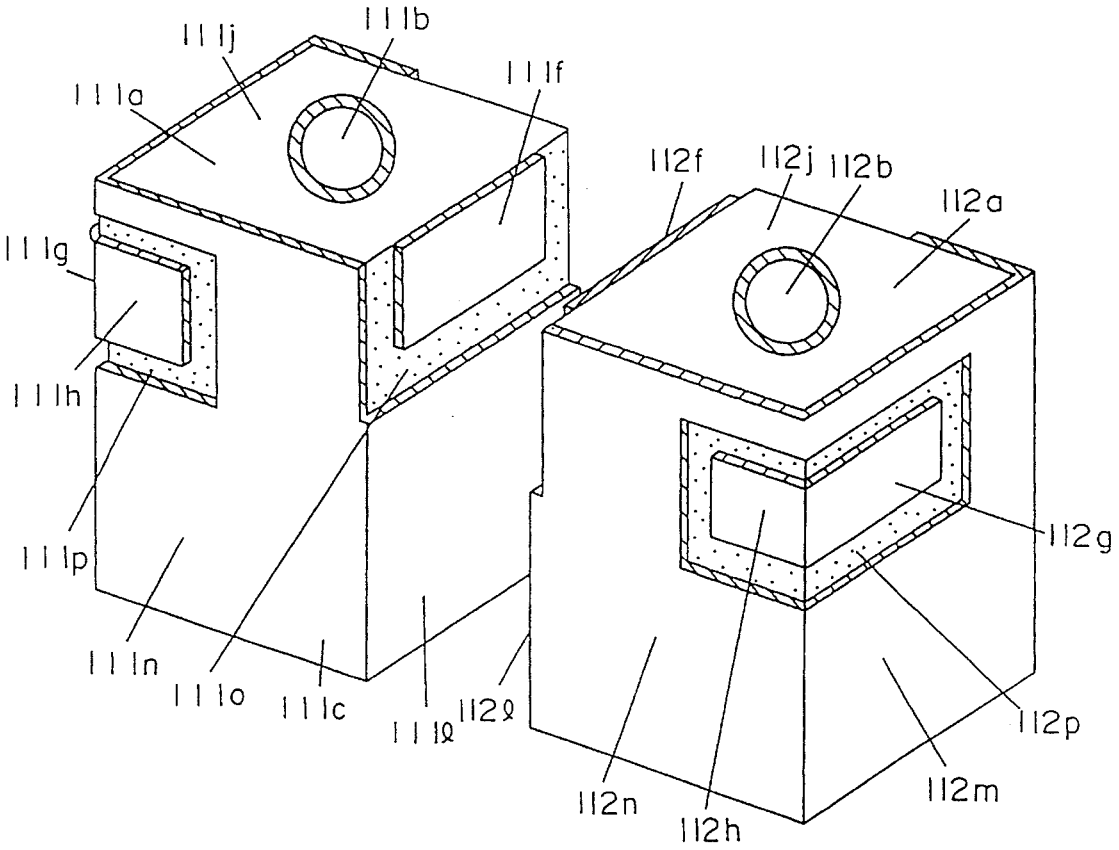
FIG. 30 is an exploded perspective view showing the dielectric filter in accordance with the fifth embodiment of the present invention.

FIGS. 29 and 30 are perspective and exploded views showing a dielectric filter of the fifth embodiment of the present invention. In FIGS. 29 and 30, reference numerals 111 and 112 represent dielectric resonators. Hereinafter, taking the dielectric resonator 111 of these two dielectric resonators, a construction of the dielectric resonator will be explained. A dielectric base body 111*a* made of dielectric material, such as $BaO-TiO_2-Nd_2O_3$, $BaO-TiO_2$, $ZrO_2-SnO_2-TiO_2$, $BaO-Sm_2O_3-TiO_2$, $Ln_2O_3-BaO-TiO_2$ series, is formed with a centrally axially extending through hole 111*b*.

The dielectric base body 111*a* has an outer configuration of rectangular parallelopiped having a square cross section, while the through hole 111*b* has a circular cross section. An outer conductors 111*c* is provided on the outer side surface of the dielectric base body 111*a* so as to surround it. An inner conductor 111*d* is provided along the inner side surface of the through hole 111*b*. The outer conductor 111*c* and the inner conductor 111*d* are connected with each other via a connecting conductor 111*e*. This connecting conductor 111*e* is provided on a closed end surface, i.e. a base of the rectangular parallelopiped, of the dielectric base body 111*a* as explained in the first embodiment with reference to FIGS. 35 and 36. Of four outer side surfaces of the dielectric base body 111*a*, one side surface 111*i* is partly cut off so that the dielectric base body 111*a* is bared near the open end 111*j*. Namely, a cutout 111*k* of the outer conductor 111*c* is formed near the open end of the dielectric base body 111*a*.

Furthermore, an interstage electrode 111*f* is provided on an outer side surface 111*l*, which is adjacent and perpendicular to the outer side surface 111*i*, near the open end 111*j*. The electrode 111*f* is provided within the region of a cutout 111*o* formed on the outer side surface 111*l*, so that the electrode 111*f* does not contact with the outer conductor 111*c*.

Moreover, there is provided input/output electrodes 111*g* and 111*h* along outer side surfaces 111*m*, 111*n* near the open end 111*j*. These electrodes 111*g* and 111*h* are provided within the region of a cutout 111*p* formed on the outer side surfaces 111*m*, 111*n*.

Likewise, the other dielectric resonator 112 comprises substantially the same components: namely, a dielectric base body 112*a*, a through hole 112*b*, an outer conductor 112*c*, an inner conductor 112*d*, a connecting conductor 112*e*, an interstage coupling electrode 112*f*, input/output coupling electrodes 112*g*, 112*h*, outer side surfaces 112*i*, 112*l*, 112*m* and 112*n*, an open end 112*j*, and cutouts 112*k*, 112*o* and 112*p*. The like parts between the dielectric resonators 111 and 112 are denoted by the same reference alphabet throughout views. (For example, the dielectric base body 111*a* is substantially identical with the dielectric base body 112*a*). However, as apparent from FIG. 30, the relationship between the dielectric resonator 111 and the dielectric resonator 112 are mirror symmetry. Therefore, in production of each dielectric resonator, it is necessary to pay attention to the positional relationship between the electrodes 111*f*, 111*g*, 111*h* and 112*f*, 112*g*, 112*h*.

More specifically, the dielectric resonator 111 and the dielectric resonator 112 are connected by means of, for example, cream solder in such a manner that the electrodes 111*f* and 112*f* confront and contact with each other and the electrodes 111*g* and 112*g* are placed in opposed and parallel relationship and the electrodes 111*h* and 112*h* are placed on the same plane.

This is because the dielectric resonators 111 and 112 are disposed in mirror symmetry relationship as explained previously.

Furthermore, the outer conductors 111*c*, 112*c*, inner conductors 111*d*, 112*d*, connecting conductors 111*e*, 112*e*, electrodes 111*f*, 112*f*, 111*g*, 112*g*, 111*h*, 112*h* (hereinafter, these components are referred to as conductor film) are basically thin film made of conductive material such as copper and silver. The thickness of the film is approximately 5 μm. Although the conductor film is a single layer in this embodiment, it is needless to say that two or more layer structure can be allowed. Regarding the film thickness of approximately 5 μm, this value should be adequately changed depending on the condition of the dielectric filter in service.

Figure 31:
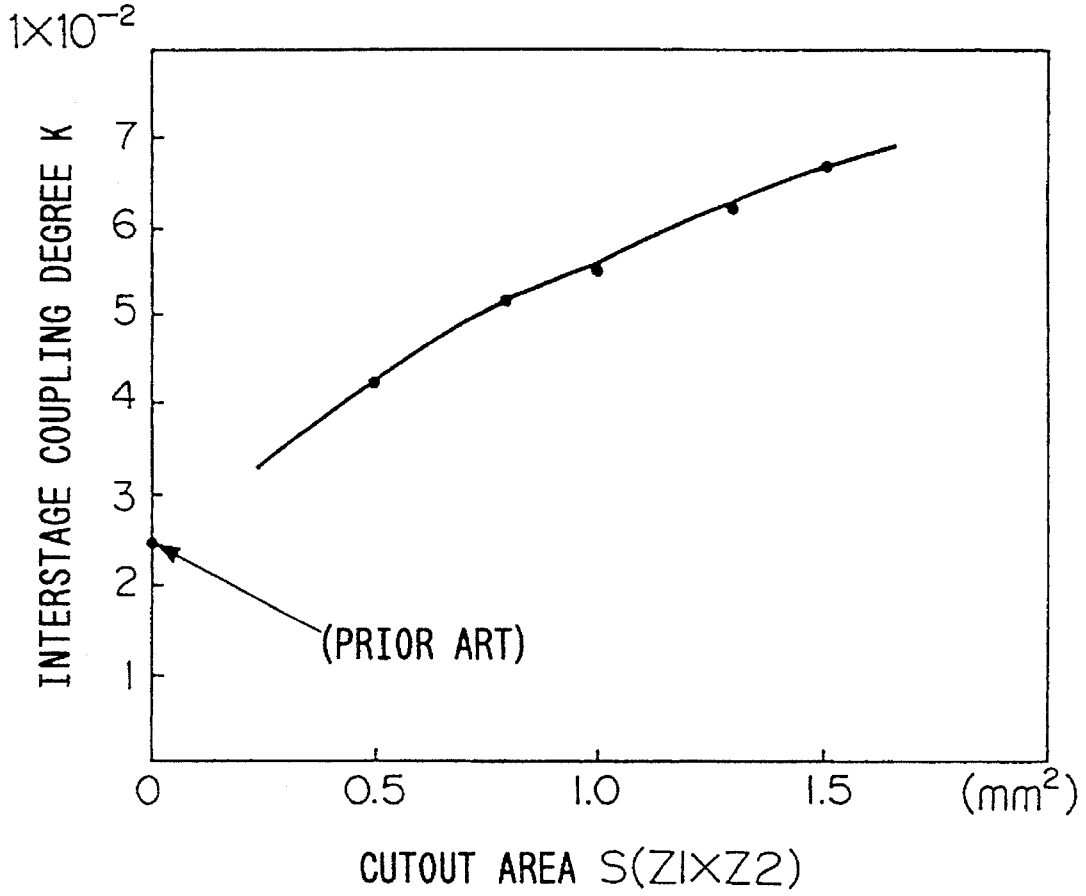
FIG. 31 is a graph showing a relationship between an area S of a cutout portion and an interstage coupling degree K in accordance with the fifth embodiment of the present invention.

FIG. 31 is a graph showing a relationship between an area S of the cutouts 111*k* and 112*k*—an area defined by Z1× Z2 in the drawing—and an interstage coupling degree K in accordance with the fifth embodiment of the present invention.

As understood from FIG. 31, the interstage coupling degree K increases with increasing area S of the cutouts 111*k* and 112*k*. Furthermore, the interstage coupling degree K can be enlarged when compared with the conventional one. Thus, it becomes possible to provide a wide-band dielectric filter.

A manufacturing method of the above-described dielectric filter will be explained hereinafter.

First of all, starting materials (for example, BaO, $TiO_2$, $Nd_2O_3$ or the like) are blended at a predetermined ratio. Then, the blended material is mixed by using a mill or else. Next, the mixed material is granulated by using a spray dryer or the like, so as to adjust the particle size and add binder. Subsequently, the granulated material is pelletized by a dry press so as to be formed into a predetermined shape. In turn, the pelletized material is sintered in a kiln at the temperature of 1300° C. to 1400° C. Thus, the dielectric base body 111*a* of cylindrical shape is obtained. Then, the conductor film is formed on the dielectric base body 111*a*. There are various method for forming the conductor film, several of which will be explained below.

A first method is applied in a case where copper is used as a material constituting the conductor film. The surface of the dielectric base body 111*a* is toughened by a barrelling machine or a blast device. Thereafter, the dielectric base body 111*a* is processed by etching until the roughness of the surface of the dielectric base body 111*a* becomes 5 μm to 9 μm. Etchant to be used in this etching will be, for example, HF-$HNO_2$ series. Subsequently, all the surface of the dielectric base body 111*a* is processed by stannous chloride or the like to give sensitivity. Then, palladium qualifying as catalytic metal is attached on all the surface of the dielectric base body 111*a*. And, a resist film is partially formed on the dielectric base body 111*a*.

Namely, this resist film 23 defines a region on which no conductor film of the dielectric base body 111*a* is provided—a region becoming the cutout 111*k*, 111*o* and 111*p*. In the formation of this resist film, resist ink is coated on the dielectric base body 111*a* by the use of printing technology or transfer technology or else and then thus printed resist ink is dried until it hardens. Next, on thus manufactured dielectric base body 111*a*, there is formed a thin, first copper film by the electroless copper plating method. In this case, the first copper film is selectively formed only within a region where the resist film is not provided.

Subsequently, a second copper film is laminated on the first copper film by the electrolytic copper plating to form the conductor film whose thickness is approximately 5 μm. After the resist film is removed by solvent or else, the electrodes are formed. Although the above manufacturing method coats the resist ink on the predetermined portion of the dielectric base body 111*a* using the printing technology and then dries and hardens the resist ink, another manufacturing method will allow the use of a photosensitive resist as a resist. That is, after the catalytic metal, such as palladium, is attached on the dielectric base body 111*a*, photosensitive resist is coated on all the surface of the dielectric base body 111*a*. Then, a predetermined portion of the photosensitive resist is exposed and hardened. Thereafter, the portion not being hardened by exposure is washed away by developing solution. Then, the electrodes will be obtained.

Another manufacturing method will form the conductor film on the dielectric base body 111*a* by coating Ag paste on the entire surface of the dielectric base body 111*a* by printing or the like method, drying this Ag paste, and applying a thermal treatment at the temperature of 800° C. to 900° C. Thereafter, the unnecessary portion of the conductor film may be removed by using the etching technology, such as chemical etching or dry etching. Thus, the electrodes are provided at the predetermined places.

Still another manufacturing method will form the electrodes, after forming the conductor film on the entire surface of the dielectric base body 111*a*, by cutting or laser machining the surface of the dielectric base body 111*a* to physically remove the predetermined portion of the surface.

The dielectric resonators 111 and 112 thus constructed are disposed in such a manner that the electrodes 111*f* and 112*f* confront with each other. Then, the outer conductors 111*c* and 112*c* are connected by means of cream solder or the like. Similarly, the electrodes 111*f* and 112*f* are connected by means of cream solder or the like.

Although this embodiment is explained based on the cutouts 111*k* and 112*k* shown in FIG. 29, the cutouts 11*k* and 112*k* can be made variously as long as they reach the open end m. Furthermore, it will be allowed to provide the cutout on either of these dielectric resonators 111 and 112.

SIXTH EMBODIMENT

Figure 32:
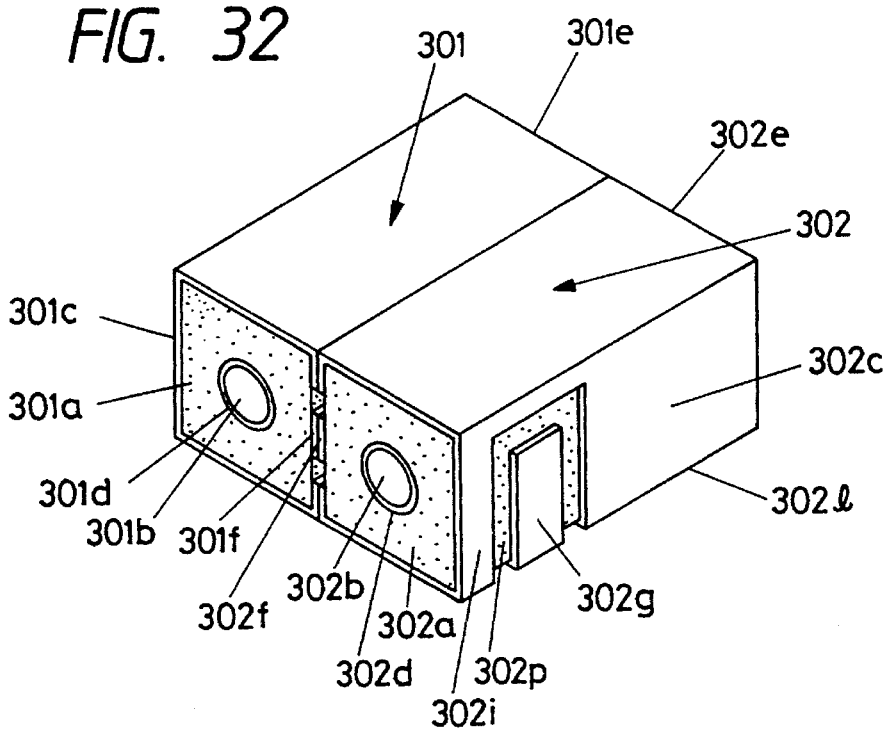
FIG. 32 is a perspective view showing a dielectric filter in accordance with a sixth embodiment of the present invention.
Figure 33:
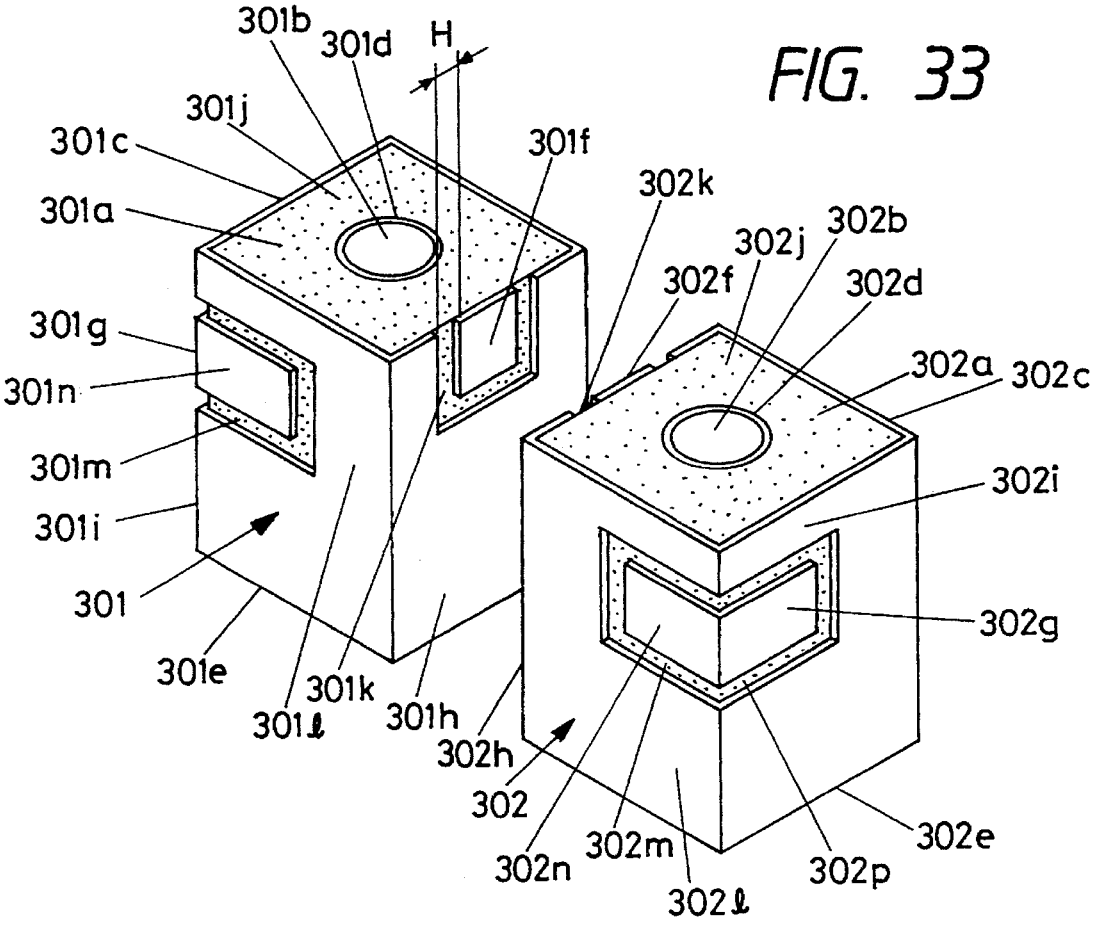
FIG. 33 is an exploded perspective view showing the dielectric filter in accordance with the sixth embodiment of the present invention.

FIGS. 32 and 33 are perspective and exploded views showing a dielectric filter of the sixth embodiment of the present invention. In FIGS. 32 and 33, reference numerals 301 and 302 represent dielectric resonators. Hereinafter, taking the dielectric resonator 301 of these two dielectric resonators, a construction of the dielectric resonator will be explained. A dielectric base body 301*a* made of dielectric material, such as $BaO-TiO_2-Nd_2O_3$, $BaO-TiO_2$, $ZrO_2-SnO_2-TiO_2$, $BaO_2-Sm_2O_3-TiO_2$, is formed with a centrally axially extending through hole 301*b*. The dielectric base body 301*a* has an outer configuration of rectangular parallelopiped having a square cross section, while the through hole 301*b* has a circular cross section. An outer conductors 301*c* is provided on the outer side surface of the dielectric base body 301*a* so as to surround it. An inner conductor 301*d* is provided along the inner side surface of the through hole 301*b*. The outer conductor 301*c* and the inner conductor 301*d* are connected with each other via a connecting conductor 301*e*. This connecting conductor 301*e* is provided on a closed end surface, i.e. a base of the rectangular parallelopiped, of the dielectric base body 301*a* as explained in the first embodiment with reference to FIGS. 35 and 36. Of four outer side surfaces of the dielectric base body 301*a*, outer side surfaces 301*i*, 301*h* and 301*l* are partly cut off so that the dielectric base body 301*a* is bared near the open end 301*j*. Namely, three cutouts 301*p*, 301*k* and 301*m* of the outer conductor 301*c* are formed near the open end of the dielectric base body 301*a*. Furthermore, an interstage electrode 301*f* is provided within the cutout 301*k* formed on the outer side surface 301*h*, so that the electrode 301*f* does not contact with other conductors. Likewise, input/output coupling electrode 301*g* (not shown), 301*n* are provided within the cutouts 301*p*, 301*m* formed on the outer side surfaces 301*i*, 301*l*, so that the electrodes 301*g*, 301*n* do not contact with other conductors. In mounting the dielectric filter on a printed circuit board, the input/output coupling electrodes 301 and 301*n* are directly connected with the conductive film (e.g. input/output pathways) by means of solder or the like.

The other dielectric resonator 302 comprises substantially the same components: namely, a dielectric base body 302*a*, a through hole 302*b*, an outer conductor 302*c*, an inner conductor 302*d*, a connecting conductor 302*e*, an interstage coupling electrode 302*f*, input/output coupling electrodes 302*g* (which is similar to the input/output coupling electrode of the dielectric resonator 301), 302*n*, outer side surfaces 302*i*, 302*h*, 302*l*, an open end 302*j*, and cutouts 302*p*, 302*m* and 302*lk*. The like parts between the dielectric resonators 301 and 302 are denoted by the same reference alphabet throughout views. (For example, the dielectric base body 301*a* is substantially identical with the dielectric base body 302*a*). However, as apparent from FIG. 33, the relationship between the dielectric resonator 301 and the dielectric resonator 302 are mirror symmetry. Therefore, in production of each dielectric resonator, it is necessary to pay attention to the positional relationship between the electrodes 301*f*, 301*g*, 301*n* and 302*f*, 302*g*, 302*n*.

More specifically, the dielectric resonator 301 and the dielectric resonator 302 are connected by means of, for example, cream solder in such a manner that the electrodes 301*f* and 302*f* confront and contact with each other and the electrodes 301*g* and 302*g* are placed in opposed and parallel relationship and the electrodes 301*n* and 302*n* are placed on the same plane. This is because the dielectric resonators 301 and 302 are disposed in mirror symmetry relationship as explained previously.

Furthermore, the outer conductors 301*c*, 302*c*, inner conductors 301*d*, 302*d*, connecting conductors 301*e*, 302*e*, electrodes 301*f*, 302*f*, 301*g*, 302*g*, 301*n*, 302*n* (hereinafter, these components are referred to as conductor film) are basically thin film made of conductive material such as copper and silver. The thickness of the film is approximately 5 μm. Although the conductor film is a single layer in this embodiment, it is needless to say that two or more layer structure can be allowed. Regarding the film thickness of approximately 5 μm, this value should be adequately changed depending on the condition of the dielectric filter in service.

Moreover, the sixth embodiment allows to vary a cutout width H of the cutouts 301*k*, 302*k*, thereby finely adjusting the interstage coupling degree of the filter. Thus, it becomes possible to set the interstage coupling degree at a desired value.

In the same manner as the first and second embodiments, this embodiment can form the through hole to have a stepped portion as shown in FIG. 15. With this arrangement, the input/output coupling capacitance can be enlarged; thus it becomes possible to obtain a wide-band dielectric filter.

Furthermore, by increasing the inner diameters of the inner conductors 301*d*, 302*d* of the dielectric resonators 301 and 302, the input/output coupling capacitance and the interstage coupling capacitance can be enlarged. Thus, it becomes possible to provide a wide-band dielectric filter.

Figure 34:
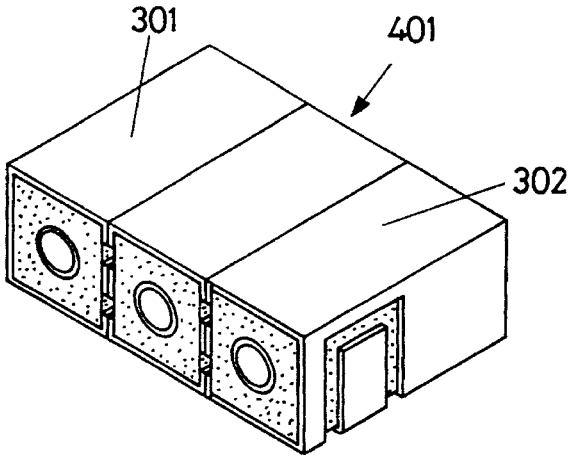
FIG. 34 is a perspective view showing a modified dielectric filter of the sixth embodiment, wherein three dielectric resonators are included.

The sixth embodiment can include three dielectric resonators as shown in FIG. 34. In this case, dielectric resonators placed at both ends (hereinafter, referred to as end resonators) are identical with those shown in FIGS. 32 and 34. A central dielectric resonator has two interstage coupling electrodes formed at opposite outer side surfaces which are to be connected to the confronting interstage coupling electrodes of the end resonators.

As this invention may be embodied in several forms without departing from the spirit of essential characteristics thereof, the present embodiment is therefore illustrative and not restrictive, since the scope of the invention is defined by the appending claims rather than by the description preceding them, and all changes that fall within meets and bounds of the claims, or equivalence of such meets and bounds are therefore intended to embraced by the claims.

What is claimed is:

1. A dielectric filter comprising:

at least two dielectric resonators, each dielectric resonator including:

a dielectric base body including first, second, third and fourth side surfaces and first and second end surfaces, wherein a through hole is provided to extend from the first end surface to the second end surface, along a central axis of the dielectric base body, to define an inner surface thereof;

an outer conductor located on the first, second, third and fourth side surfaces, wherein the outer conductor covers the entire first and second side surfaces and covers a portion of the third and fourth side surfaces, thereby leaving an uncovered portion of the third side surface that is adjacent to an uncovered portion of the fourth side surface, and wherein the uncovered portions of the third and fourth side surfaces are adjacent to the first end surface and respectively extend across a corresponding width of the third and fourth side surfaces;

an inner conductor located on the inner surface of the dielectric base body;

a connection conductor located on the second end surface of the dielectric base body, wherein the connection conductor connects the inner conductor to the outer conductor;

an interstage coupling electrode located on the uncovered portion of the third side surface, wherein an area of the uncovered portion of the third side surface extends in three directions from the interstage coupling electrode and separates the interstage coupling electrode from the outer conductor and the second and fourth side surfaces; and an input/output coupling electrode located on the uncovered portion of the fourth Side surface, wherein an area of the uncovered portion of the fourth side surface extends in three directions from the input/output coupling electrode and separates the input/output coupling electrode from the outer conductor and the first and third side surfaces;

wherein the dielectric resonators are connected with each other in such a manner that the outer conductor of a first one of the dielectric resonators is electrically connected to the outer conductor of a second one of the dielectric resonators.

2. A dielectric filter as claimed in claim 1, wherein the through hole located in each base body includes a first portion having a circular cross section and a second portion having a square cross section.

3. A dielectric filter as claimed in claim 1, wherein the interstage coupling electrode of a first one of the dielectric resonators is electrically connected to the interstage coupling electrode of a second one of the dielectric resonators.

4. A dielectric filter as claimed in claim 1, wherein the through hole located in each base body has a circular cross section.

5. A dielectric filter as claimed in claim 1, wherein the through hole located in each base body is in a step shape configuration.

* * * * *